US006684036B2

(12) United States Patent
Kubota et al.

(10) Patent No.: US 6,684,036 B2
(45) Date of Patent: Jan. 27, 2004

(54) IMAGE FORMING APPARATUS

(75) Inventors: Keisuke Kubota, Hitachinaka (JP); Teruaki Mitsuya, Hitachinaka (JP); Hiroyuki Mabuchi, Hitachinaka (JP); Masayoshi Ishii, Hitachinaka (JP); Shinichi Akatsu, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 10/092,522

(22) Filed: Mar. 8, 2002

(65) Prior Publication Data

US 2002/0127027 A1 Sep. 12, 2002

(30) Foreign Application Priority Data

Mar. 9, 2001 (JP) ..... 2001-066086
May 18, 2001 (JP) ..... 2001-148869

(51) Int. Cl.[7] ..... G03G 15/00
(52) U.S. Cl. ..... 399/55; 399/44; 399/48
(58) Field of Search ..... 399/55, 48, 44

(56) References Cited

U.S. PATENT DOCUMENTS 3,976,375 A * 8/1976 Kurita et al. ..... 399/160
4,888,618 A * 12/1989 Ishikawa ..... 399/39
4,962,407 A * 10/1990 Ueda ..... 399/168 X
5,034,772 A * 7/1991 Suzuki ..... 399/44
5,659,841 A * 8/1997 Umeda et al. ..... 399/55
5,768,665 A * 6/1998 Yamanaka et al. ..... 399/235
5,943,526 A * 8/1999 Kodama ..... 399/66

FOREIGN PATENT DOCUMENTS

JP 2-221973 * 9/1990
JP 2-222973 * 9/1990
JP 3-293379 * 12/1991
JP 9-230688 * 9/1997
JP 11-015214 * 1/1999

* cited by examiner

*Primary Examiner*—Quana M. Grainger
(74) *Attorney, Agent, or Firm*—Antonelli, Terry, Stout & Kraus, LLP

(57) ABSTRACT

An image forming apparatus restricts disturbance of a potential patch in the case where a potential sensor for detecting the potential patch is provided downstream of a developing device of a multiple developing roller type so as to enable stable reproduction of a high quality image for a long period. The apparatus includes a potential sensor provided downstream in the moving direction of the image carrier relative to the developing device for detecting a potential on the image carrier, and a controller for setting the developing bias to a value restricting disturbance of a potential portion as an object for potential detection by the potential sensor by the developer when the potential portion passes across the developing device.

21 Claims, 14 Drawing Sheets

| | | HUMIDITY | | |
|---|---|---|---|---|
| | | <20%RH | <65%RH | <100%RH |
| CHARGE DENSITY | <0.03 μC/cm² | 40V | 60V | 80V |
| | <0.04 μC/cm² | 70V | 90V | 110V |
| | <0.05 μC/cm² | 100V | 120V | 140V |

IMAGE FORMING APPARATUS

BACKGROUND OF THE INVENTION

The present invention relates to an image forming apparatus, such as a printer, a copy machine, a facsimile and so on.

The conventional image forming apparatus, such as a printer, a copy machine, a facsimile and so on, uses a so-called electrophotographic process, in which the surface of a photo conductor operating as an image carrier is uniformly charged, an image is exposed on the charged photo conductor surface for producing an electrostatic latent image thereon, a developer is supplied to the photo conductor carrying the electrostatic latent image for developing the electrostatic latent image, and a toner image thus formed on the photo conductor is transferred to a sheet of paper, an OHP sheet or a recording body, such as an intermediate transfer body, to obtain a printed image.

In an image forming apparatus of this kind, for the purpose of stably reproducing images with a high image quality over a long period of time, there is a known mechanism in which a patch is formed on the surface of the image carrier body before initiation of the printing operation, after the printing operation or during the printing operation, and various parameters associated with printing are controlled on the basis of the information obtained from the patch. Here, in the patch employed for such control, there are techniques for performing control using a "toner patch" formed by depositing toner on the image carrier body and a technique for performing control using a "potential patch" formed as a latent image, without depositing any toner.

In the case of the toner patch system, since a toner image has to be formed on the image carrier body, an extra amount of toner is consumed. Furthermore, since the toner patch subsequently has to be removed from the image carrier body, the load on the cleaning device of the apparatus tends to be increased.

In contrast to this, in the case of a potential patch, it is sufficient to form the latent pattern on the image carrier body during the charging step and exposure step to solve the problems set forth above. In this type of system, as disclosed in Japanese Patent Application Laid-Open No. Heisei 9 (1997)-230688, it is typical to provide a potential sensor for detecting the potential patch between the exposure device and the developer device for detecting the potential upstream of the developer device. However, when the a printing speed of the image forming apparatus is increased, a greater amount of developer has to be supplied to the image carrier body. As one approach to satisfy this requirement, a multiple stage developing roller system having a plurality of developing rollers has been employed. However, when such a multiple stage developing roller type developing device is employed, which results in an increase in the size of the apparatus, a difficulty is encountered in providing sufficient space for mounting a potential sensor between the exposure device and the developing device.

In addition, mounting the potential sensor between the exposure device and the developing device also is not always appropriate simply from the view point of increasing the printing speed. Namely, it is possible that the potential patch may pass below the potential sensor before the potential of the exposure portion drops down (decays) to the predetermined potential, due to the optical response characteristics of the image carrier body (photo conductor), thereby making it impossible to accurately detect the potential patch.

SUMMARY OF THE INVENTION

Accordingly, an object of the present invention is to provide an image forming apparatus which restricts disturbance of a potential patch, in the case where a potential sensor for detecting the potential patch is provided on the downstream side of a developing device of a multiple developing roller type, thereby to enable stable reproduction of a high quality image for a long period of time.

In order to accomplish the above-mentioned and other objects, according to a first aspect of the present invention, an image forming apparatus comprises: charging means for charging the surface of an image carrier; exposure means for exposing an image on the charged image carrier for forming a latent image; developing means, including a plurality of developing rollers arranged in opposition with a surface of the image carrier and bias applying means for applying a developing bias to the plurality of developing rollers, for supplying a developer on the image carrier and forming a developed image on the image carrier; transfer means for transferring the developed image formed on the image carrier onto a printing medium; a potential sensor provided downstream in the moving direction of the image carrier relative to the developing means for detecting a potential on the image carrier; and control means for setting the developing bias to a value restricting disturbance of a potential portion, representing an object for potential detection by the potential sensor, by the developer when the potential portion passes across the developing means.

Preferably, setting of the developing bias for the plurality of developing rollers may be performed in sequential order from the developing roller arranged on the upstream side in the moving direction of the image carrier.

According to a second aspect of the present invention, an image forming apparatus comprises: an image carrier; charging means for charging the surface of the image carrier; exposure means for exposing an image on the charged image carrier for forming an exposure portion potential region; developing means, including a plurality of developing rollers arranged in opposition with a surface of the image carrier, bias applying means for applying a developing bias to the plurality of developing roller and a two component developer, for supplying a developer on the image carrier and forming a developed image on the image carrier; transfer means for transferring the developed image formed on the image carrier onto a printing medium; a potential sensor provided downstream in the moving direction of the image carrier relative to the developing means for detecting a potential on the image carrier; and control means for setting the developing bias to a value for restricting deposition of toner on the exposure portion potential region when the exposure portion potential region passes across the developing means.

According to a third aspect of the present invention, an image forming apparatus comprises: an image carrier; charging means for charging the surface of the image carrier; exposure means for exposing an image on the charged image carrier for forming an exposure portion potential region; developing means, including a plurality of developing rollers arranged in opposition with a surface of the image carrier, bias applying means for applying a developing bias to the plurality of developing rollers and a two component developer, for supplying a developer on the image carrier and forming a developed image on the image carrier; transfer means for transferring the developed image formed on the image carrier onto a printing medium; a potential sensor provided downstream in the moving direction of the image carrier relative to the developing means for detecting a charge potential and an exposure potential on the image carrier; and control means for applying the developing bias at a value which restricts the splashing of carrier onto the surface of the image carrier, when the charge potential region passes through the developing means, and sets the developing bias to a value for restricting deposition of toner onto the exposure portion potential region when the exposure portion potential region passes across the developing means.

According to a fourth aspect of the present invention, an image forming apparatus comprises: an image carrier; charging means for charging the surface of the image carrier; exposure means for exposing an image on the charged image carrier for forming an exposure portion potential region; developing means, including a plurality of developing rollers arranged in opposition with a surface of the image carrier, bias applying means for applying a developing bias to the plurality of developing rollers and a two component developer, for supplying a developer on the image carrier and forming a developed image on the image carrier; transfer means forming a transfer nip portion by contacting the surface of the image carrier and transferring the developed image formed on the image carrier onto a printing medium in the transfer nip; a potential sensor provided downstream in the moving direction of the image carrier relative to the developing means for detecting a charge potential and an exposure potential on the image carrier; and control means for applying the developing bias at a value which restricts the splashing of carrier onto the surface of the image carrier when the charge potential region passes through the developing means, and sets the developing bias to a value for restricting deposition of toner onto the exposure portion potential region when the exposure portion potential region passes across the developing means.

In the preferred construction, the developing bias may be reduced in sequential order from the developing roller arranged upstream in the moving direction of the image carrier upon reducing the developing bias of a plurality of developing rollers. The developing bias also may be applied in sequential order from the developing roller arranged upstream in the moving direction of the image carrier upon applying a developing bias to a plurality of developing rollers.

The image forming apparatus may further comprise: layer thickness detecting means for detecting the layer thickness of the image carrier; a humidity sensor for detecting the humidity around the image carrier; and dark decay storage means for storing a value representing the potential drop due to dark decay of the image carrier corresponding to detection values of the layer thickness detecting means and the humidity sensor, whereby at least one of the charge voltage level of the charging means and the light output of the exposure means is corrected on the basis of the potential drop derived from the detection values of the layer thickness detecting means and the humidity sensor.

According to a fifth aspect of the present invention, an image forming apparatus comprises: an image carrier; charging means for charging the surface of the image carrier; exposure means for exposing an image on the charged image carrier for forming an exposure portion potential region; developing means, including a developing roller arranged in opposition with a surface of the image carrier, bias applying means for applying a developing bias to the developing roller and a two component developer, for applying the developer held on the developing roller to the surface of the image carrier at a developing nip for supplying developer to the image carrier to form a toner image on the image carrier in the developer nip; transfer means for transferring the toner image formed on the image carrier onto a printing medium in a transfer nip; a potential sensor provided downstream in the moving direction of the image carrier relative to the developing means for detecting a charge potential and an exposure potential on the image carrier; and control means for setting the developing bias to a value for restricting deposition of toner onto the exposure portion potential region when a tip end of the exposure portion potential region reaches a rear end of the developing nip in the moving direction of the image carrier.

The image forming apparatus preferably comprises means for controlling the potential of an image region, on the basis of a detection value of the potential sensor, to maintain the potential constant, detecting the layer thickness of a photo conductor layer forming the image carrier, and controlling the peripheral electric field of the image region.

The image forming apparatus may include: a first potential sensor arranged within a range from the developing means toward the charging means in the moving direction of the image carrier, and a second potential sensor arranged within a range from the charging means toward the developing means in the moving direction of the image carrier, wherein the potential of the charge potential region is controlled so as to be constant on the basis of a detection value of the second potential sensor, and the layer thickness of the photo conductor is detected on the basis of a detection value of the first potential sensor.

The image forming apparatus may employ an auxiliary exposure for controlling the peripheral electric field. For this purpose, an auxiliary exposure light is irradiated at a position of transition from a potential of the charge potential region to the exposure potential region for forming a step in the potential distribution. At least one stepwise potential distribution may be formed between the developing bias voltage and the potential of the charge potential region.

The image forming apparatus may further comprise means for detecting the potential of an image region, where a latent image exists, using a potential sensor, controlling the potential of the image region, other than a solid image region, among the image regions, on the basis of detection values thereof, detecting a layer thickness of the photo conductor, and controlling a peripheral electric field of the image region, including the solid image.

BRIEF DESCRIPTION OF THE DRAWINGS

The present invention will be understood more fully from the detailed description given hereinafter and from the accompanying drawings of a preferred embodiment of the present invention, which, however, should not be taken to be limitative to the invention, but are for explanation and understanding only.

In the drawings.

DESCRIPTION OF THE PREFERRED EMBODIMENT

Figure 1:
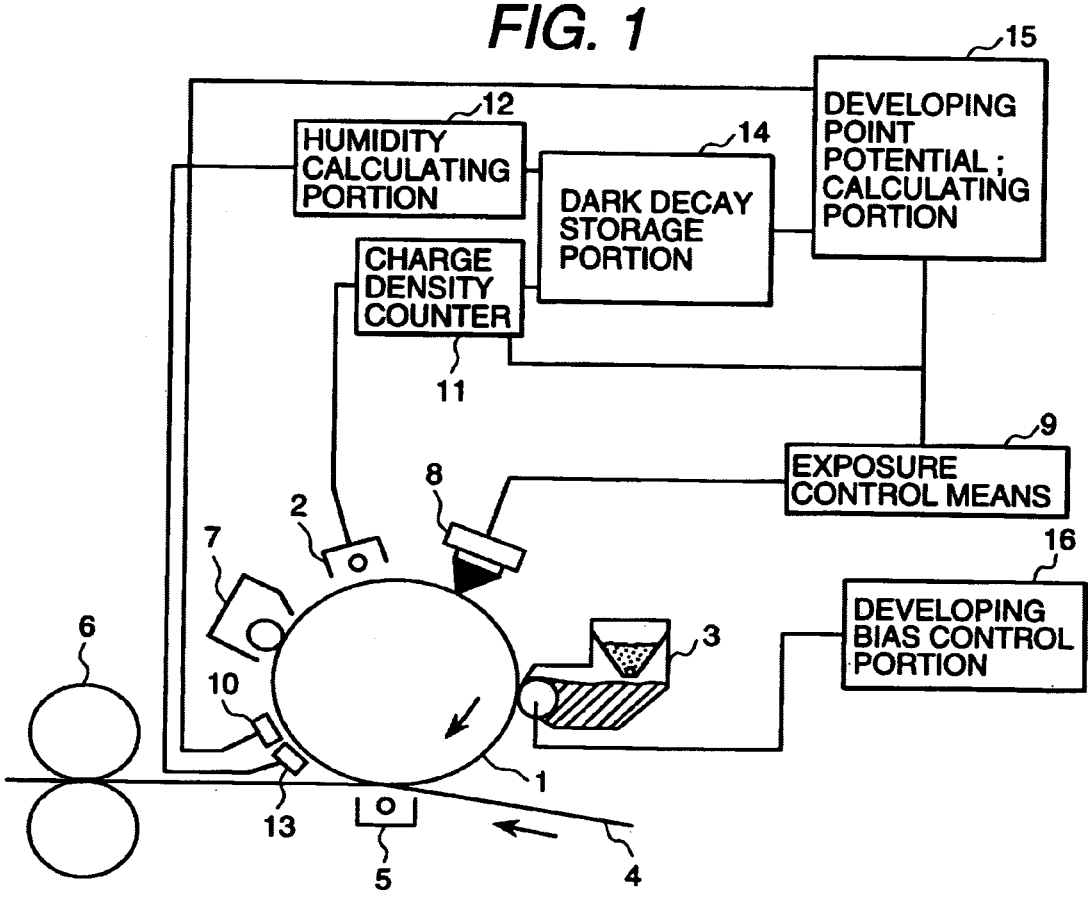
FIG. 1 is a schematic block diagram of a preferred embodiment of an image forming apparatus according to the present invention.

The present invention will be discussed hereinafter in detail in terms of preferred embodiments of the present invention and with reference to the accompanying drawings. In the following description, numerous specific details are set forth in order to provide a thorough understanding of the present invention. It will be obvious, however, to those skilled in the art that the present invention may be practiced without these specific details. In some instances, well-known structure is not shown in detail in the drawings in order to avoid unnecessary obscurity of the present invention.

FIG. 1 is a schematic block diagram of a preferred embodiment of an image forming apparatus according to the present invention. The image forming apparatus includes a photo conductor drum 1, as one example of an image carrier, a charger 2, a developing device 3, a sheet of printing paper 4 as one example of a printing medium, a transfer device 5, a fixing device 6, a cleaning device 7, an exposure device 8, an exposure control means 9, a potential sensor 10, a charge density counter 11, a humidity calculating portion 12, a temperature and humidity sensor 13, a dark decay storage portion 14, a developing point potential calculating portion 15 and a developing bias control portion 16.

The photo conductor drum 1, which is uniformly charged by the charger 2, is exposed to form an image by the exposure device 8, which includes a semiconductor laser and its optical system, the light emission of which is controlled by exposure control means 9, such as a laser driver or the like, to form an electrostatic latent image on the surface of the photo conductor drum 1.

The electrostatic latent image formed on the photo conductor drum 1 is developed by the developing device 3 to form a toner image. The toner image formed on the photo conductor drum 1 is transferred to a sheet of printing paper 4 by a transfer device 5. Subsequently, the toner image transferred to the printing paper 4 is heat-fused by the fixing device 6. On the other hand, residual toner on the photo conductor drum 1, that is not transferred to the printing paper 4 and which remains thereon, is collected by the cleaning device 7. Then, the printing process is finished.

The potential of the surface of the photo conductor drum 1 is detected by the potential sensor 10 arranged downstream in the rotating direction of the photo conductor drum with respect to the developing device 3. The amount of exposure produced by the exposure device 8 can be adjusted by the exposure control means 9 on the basis of a "corrected detection value=($|Vr'|+\beta$)", which is derived by adding the dark decay potential amount $\beta$ to a detection value Vr'. On the other hand, the charge density of the surface of the photo conductor drum 1 is counted by the charge density counter 11, and the amount of exposure produced by the exposure device 8 is adjusted by the exposure control means 9 on the basis of the counted value.

Next, the discussion will be directed to a potential detection method carried out at a position downstream of the image transfer in terms of an exposure portion potential Vr on the photo conductor drum 1 as a detection object by the potential sensor 10, for example.

The exposure portion potential Vr formed on the photo conductor drum 1 by the exposure device 8 is developed to form a toner image by a potential difference relative to a developing bias Vb applied by the developing roller and tends to be approximately equal to the developing bias Vb. In short, the potential on the surface of the photo conductor drum 1 is determined by adapting it to the level of the developing bias Vb.

Accordingly, in the illustrated embodiment, in order to accurately detect the exposure portion potential Vr, control is performed for setting the developing bias Vb so as not to develop the latent image to form a toner image on the surface of the photo conductor drum.

Figure 2:
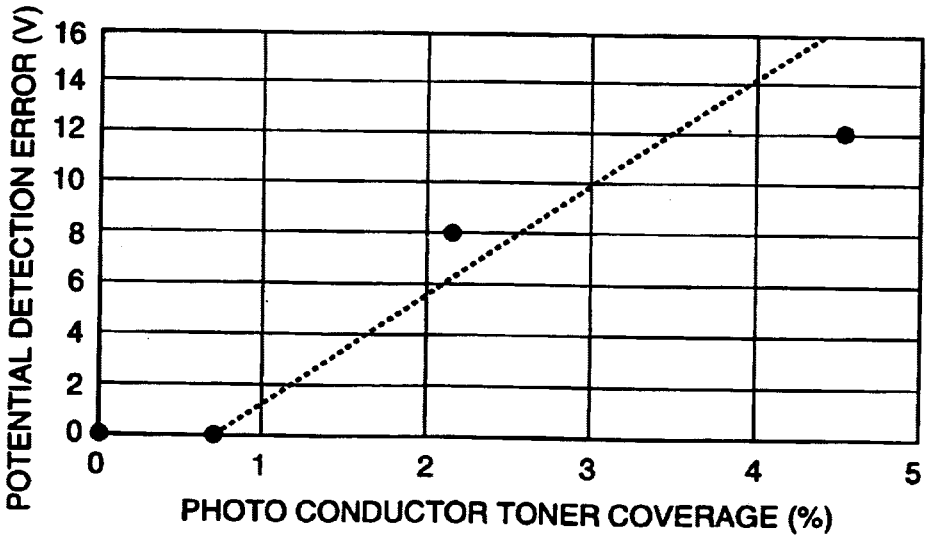
FIG. 2 is a graph showing toner coverage versus potential sensor detection error.

FIG. 2 is plotted with the toner coverage on the surface of the photo conductor drum 1 shown on the horizontal axis and a detection error produced by the potential sensor 10 shown on the vertical axis. In the embodiment, as a condition where the detection value of the potential sensor 10 is not influenced by toner development, the development bias is set so that toner coverage on the surface of the photo conductor drum 1 becomes less than or equal to 0.7%.

Figure 3:
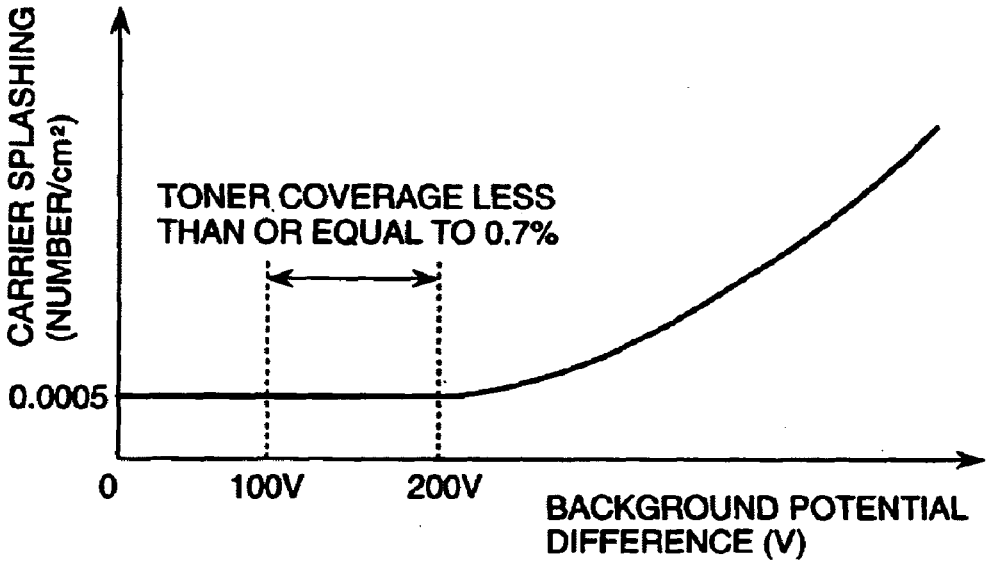
FIG. 3 is a graph showing a relationship between a background potential difference and carrier splashing.

FIG. 3 is an illustration showing a carrier splashing number associated with setting of the developing bias. In FIG. 3, the horizontal axis represents the background potential difference and the vertical axis represents the carrier splashing number. When a two-component developing system is employed as the developing system, if the developing bias is reduced at a timing where a region of the background potential (charged potential region) passes through the developing roller, the potential difference between the developing bias Vb' after reduction of the developing bias and the background potential becomes large so as to draw a carrier charged at the opposite polarity to the toner by an electrical field in a direction toward the photo conductor formed by the developing bias Vb' and the background potential, so as to cause carrier splashing.

Therefore, in accordance with the present invention, the background potential difference is set so as not to cause carrier splashing and to satisfy the condition that the toner coverage on the photo conductor drum be less than or equal to 0.7%. The developing bias Vb', after the reduction, is set so that the background potential difference may fall within a range between 100V to 200V in the embodiment.

Figure 4:
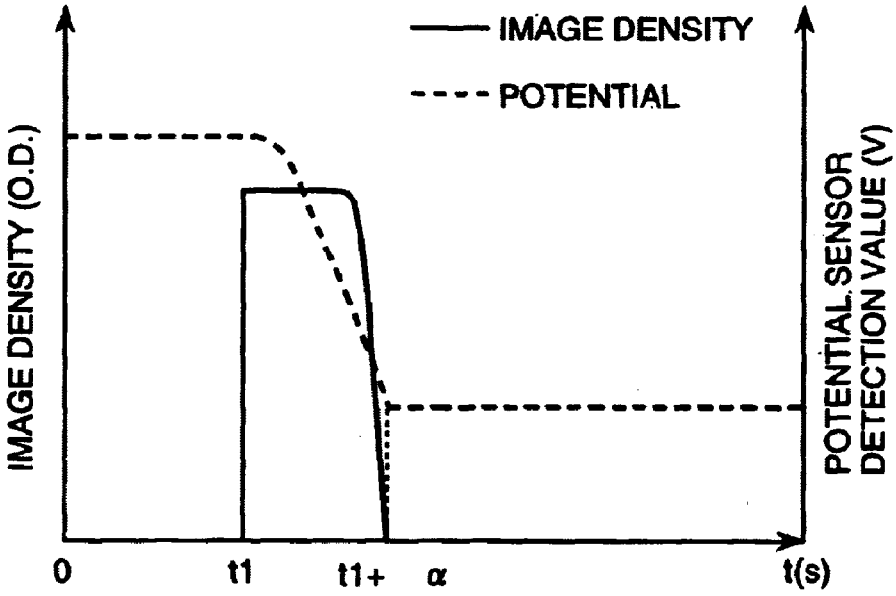
FIG. 4 is a diagram showing a toner developing region on a photo conductor when carrier splashing is not caused.
Figure 5:
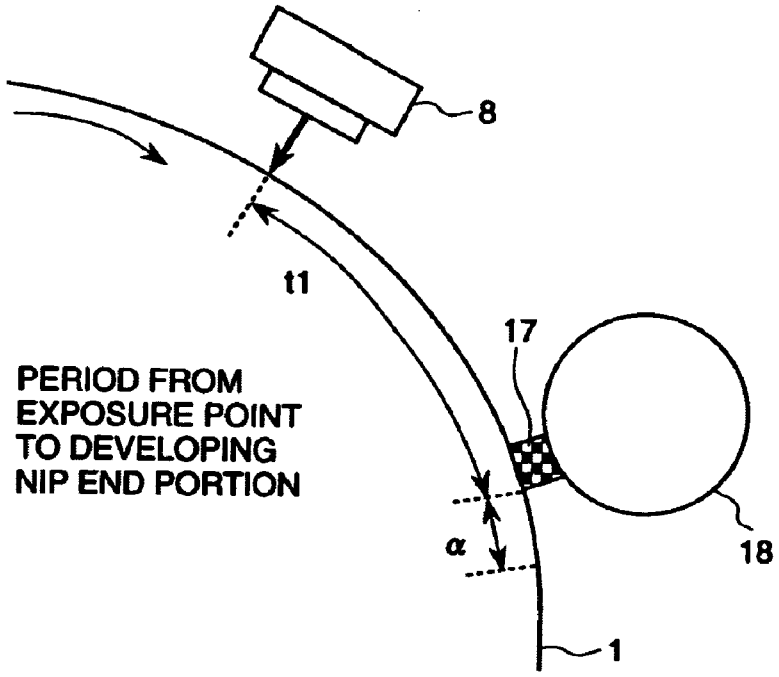
FIG. 5 is a diagrammatic illustration showing a timing of elimination of a developing bias of a developing device having a single developing roller.

FIG. 4 is an illustration showing a case where reduction of the developing bias is actually performed and the potential after image transfer is detected. In FIG. 4, the horizontal axis represents time and the vertical axis represents image density and a detection value of the potential sensor. FIG. 5 diagrammatically shows the timing used for reducing the developing bias in the case of a developing device having a single developing roller 18 and a developing nip 17. In order to reduce occurrence of carrier splashing, it becomes necessary to avoid the developing bias at a time when the detection objective potential Vr passes across the developing nip portion. The period t1 from the exposure point to pass through the developing nip portion is preliminarily measured. By changing the developing bias from Vb to Vb' at a timing after a period t1 from the exposure timing upon potential detection, a condition for satisfying prevention of carrier splashing and prevention of detection error of the potential sensor by toner development can be established.

On the other hand, the potential detection timing at this time is set with a delay for a period corresponding to a total period $\Delta\alpha$ of a period corresponding to the developing nip width and a falling down (decay) period of the internal power source for supplying the developing bias, which total period corresponds to a period in which the toner image of a width in the circumferential direction of the photo conductor drum is formed through development.

Accordingly, in the illustrated embodiment of the image forming apparatus, by setting the level of reduction of the development bias and timing as set forth above, potential detection by the potential sensor after development becomes possible.

Next, discussion will be given for the case of a development device having two or more developing rollers 18, with reference to FIG. 6. When the developing bias of two or more developing rollers 18 is changed simultaneously, considering carrier splashing, the toner image is formed on the photo conductor drum by development in response to the developing potential difference of one developing roller for a distance Ad between the developing nips 17. When the number of the developing rollers is N, the toner image is formed in a range 19 of $(N-1)\times\Delta d$ in the peripheral direction of the photo conductor by development. From this, it should be easily appreciated that the potential detection region is significantly increased according to an increase in the number of developing rollers.

In order to solve the foregoing problem, in the illustrated embodiment, a method is adopted to change the developing bias in sequential order from the upstream side in the rotating direction of the photo conductor, such as respective timings t1, t2 for the developing device having two or more developing rollers. In this way, potential detection becomes possible at an area equal to that of the image forming apparatus having a single developing roller.

Figure 6:
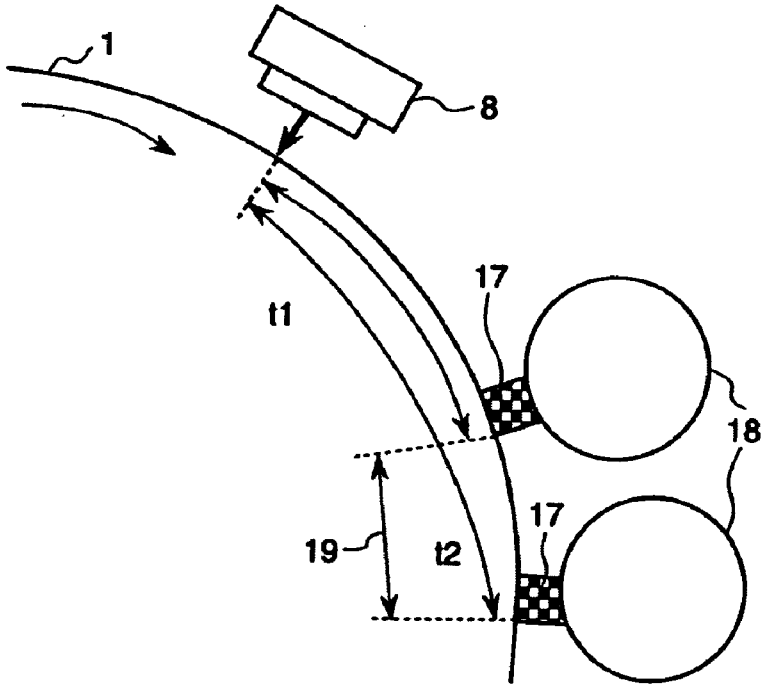
FIG. 6 is a diagrammatic illustration showing a timing of elimination of a developing bias of a developing device having two developing rollers.

It should be noted that while the developing device having two developing rollers is exemplarily illustrated in FIG. 6, a similar method can also be employed for a developing device having three or more developing rollers. On the other hand, the potential level of the developing bias after reduction and the timing of reduction of the developing bias are the same as those in the case of the developing device having one developing roller.

Figure 7:
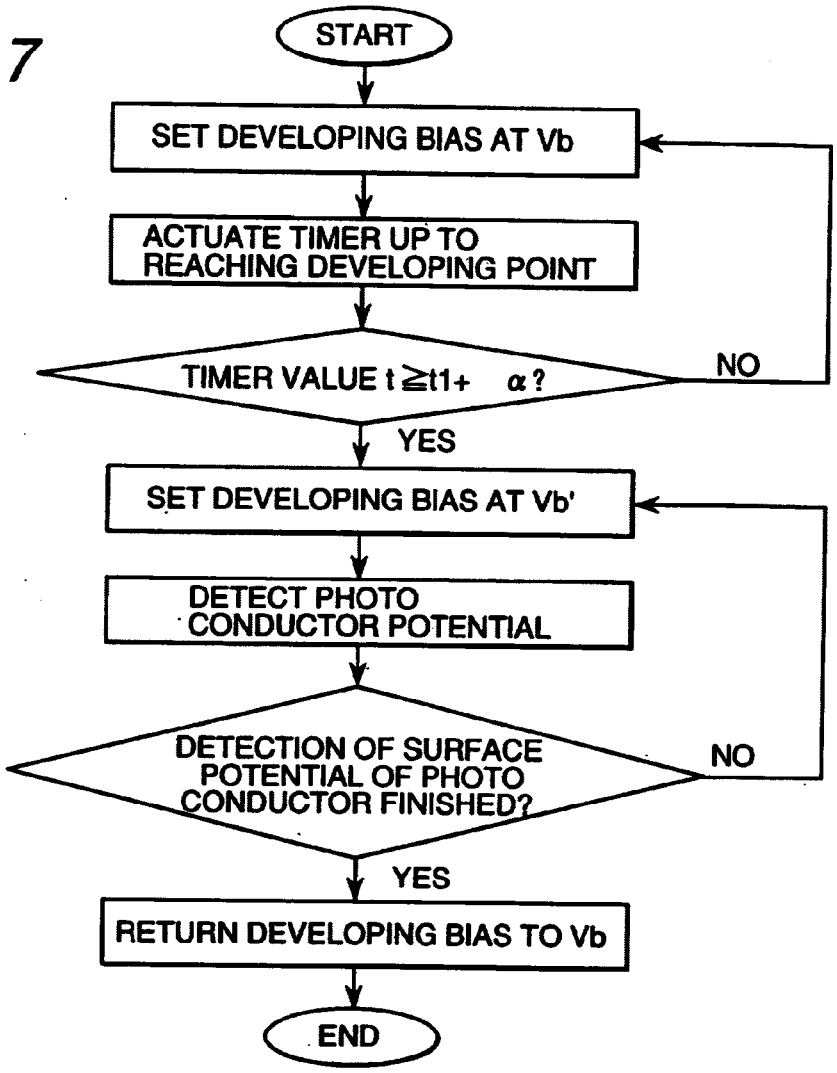
FIG. 7 is a flowchart of a developing bias control method of detecting a potential after development.

FIG. 7 is a flowchart of a developing bias control for detecting the potential on an upstream side of the developing roller in the rotating direction of the photo conductor. Furthermore, in the illustrated embodiment of the image forming apparatus, a system for adding a potential correction amount is employed for reproducing the potential at the position of the developing device. The detection value of the potential sensor includes a dark decay component depending upon elapsed time after exposure of the photo conductor; and, thus, the potential at the timing of development is different from the potential detection value after transfer. The dark decay characteristics of the photo conductor are variable depending upon the layer thickness of the photo conductor and the humidity.

Figure 8:
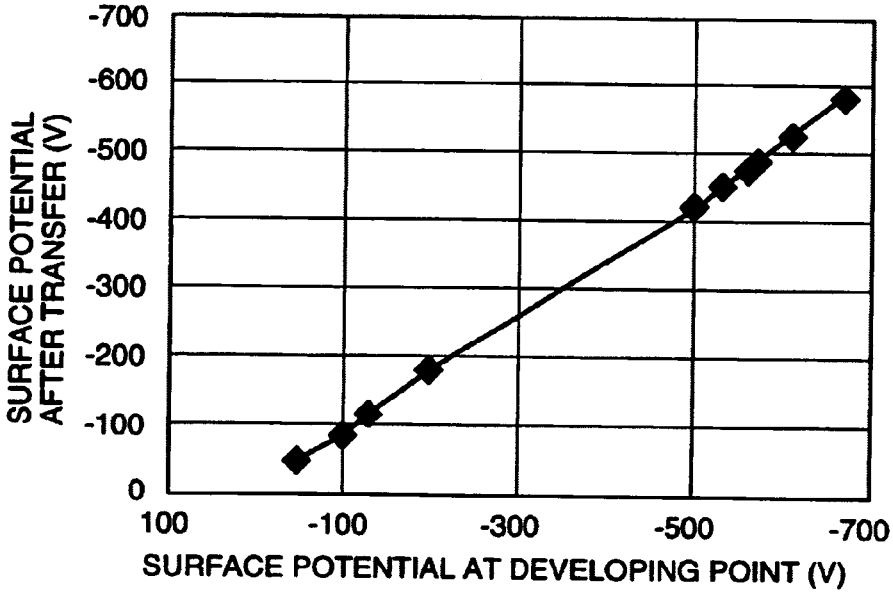
FIG. 8 is a graph showing a surface potential of the photo conductor at a developing position and a position after development.

FIG. 8 shows the detection values of the potential sensor at the developing position and a transfer position. In FIG. 8, the horizontal axis represents the surface potential of the photo conductor at the developing point, and the vertical axis represents the surface potential of the photo conductor after transfer. It should be appreciated that the charge potential of the photo conductor is lowered depending upon the elapsed period from charging to detection. This is noted as a potential drop component due to the dark decay characteristics of the photo conductor.

Figure 9:
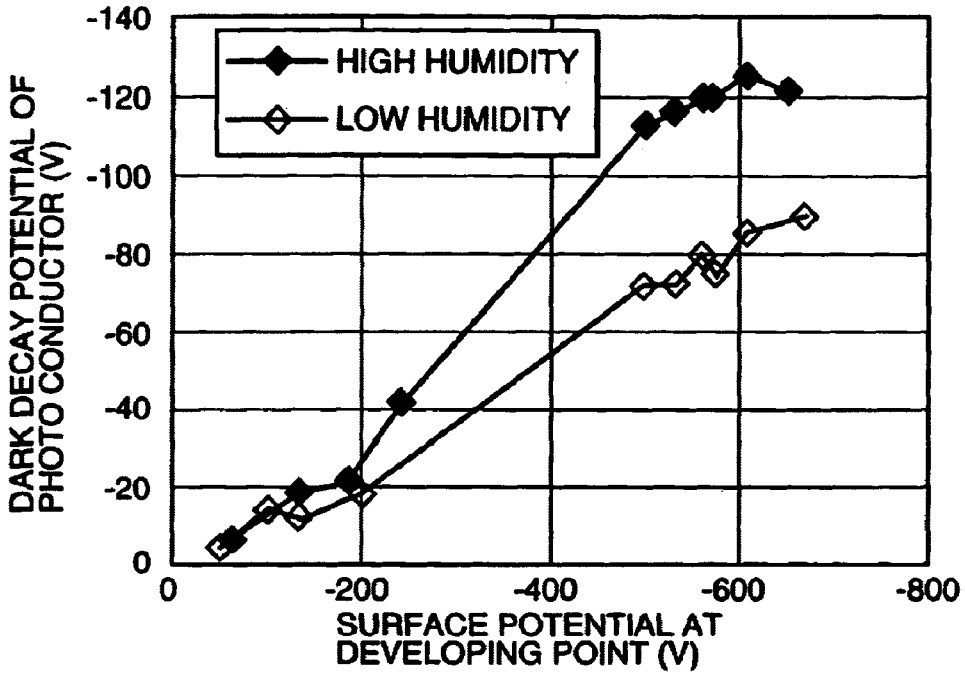
FIG. 9 is a graph showing dark decay characteristics of the photo conductor depending upon humidity.

FIG. 9 shows a result of the potential drop due to dark decay of the photo conductor depending upon humidity. At a lower environmental humidity of the photo conductor, the potential drop due to dark decay is lower. Conversely, at a higher humidity, the potential drop becomes greater.

Figure 10:
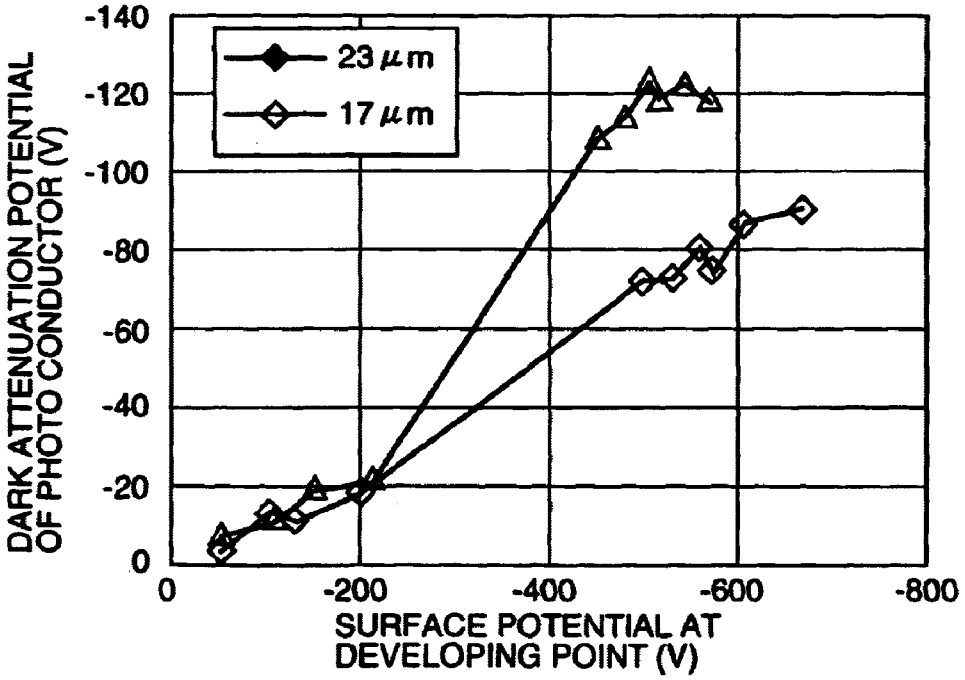
FIG. 10 is a graph showing dark decay characteristics of the photo conductor depending upon layer thickness.

FIG. 10 shows the dark decay variation depending upon the layer thickness of the photo conductor. According to an increase in the number of printing sheets, the layer thickness of the photo conductor is reduced to increase the potential drop due to dark decay. As can be appreciated from the results shown in FIGS. 8 to 10, the dark decay of the photo conductor depends on the atmospheric environment of the photo conductor and the layer thickness of the photo conductor. Therefore, a dark decay potential amount $\beta$ is preliminarily measured. In the illustrated embodiment, a method of predicting the layer thickness of the photo conductor by deriving a charge density on the surface of the photo conductor is calculated by a charge density counter 11 as a parameter depending upon the layer thickness of the photo conductor. Accordingly, the dark decay potential amount β is preliminarily set in a table established in terms of the humidity and the charge density of the surface of the photo conductor. The dark decay potential amount β set in the table is stored in the dark decay storage portion 14.

Figure 12:
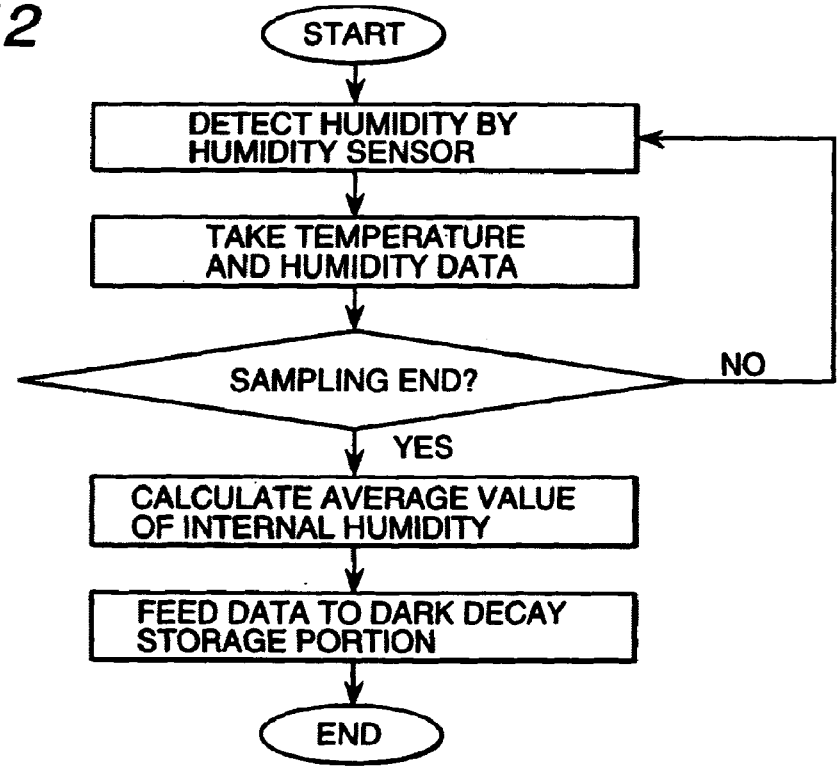
FIG. 12 is a flowchart showing a process of humidity detection.
Figures 13, 15:
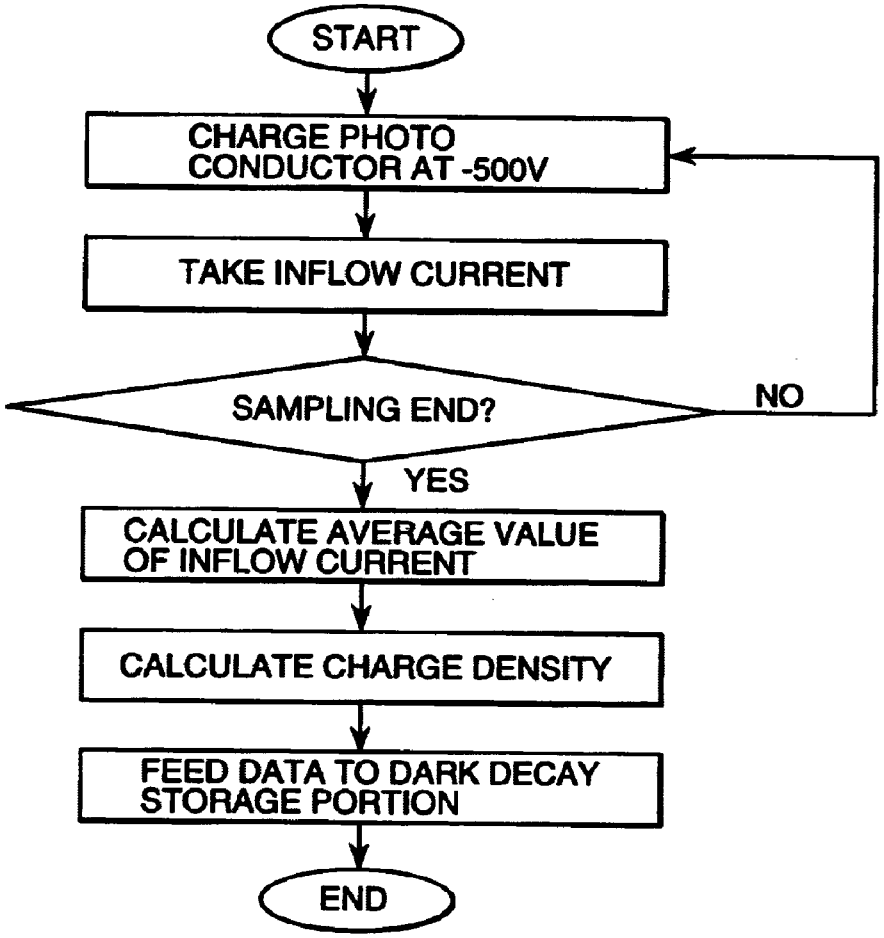
FIG. 13 is a flowchart showing a process of calculation of the surface charge density of the photo conductor.
FIG. 15 is one example of a matrix table of a dark decay storage portion.
Figure 14:
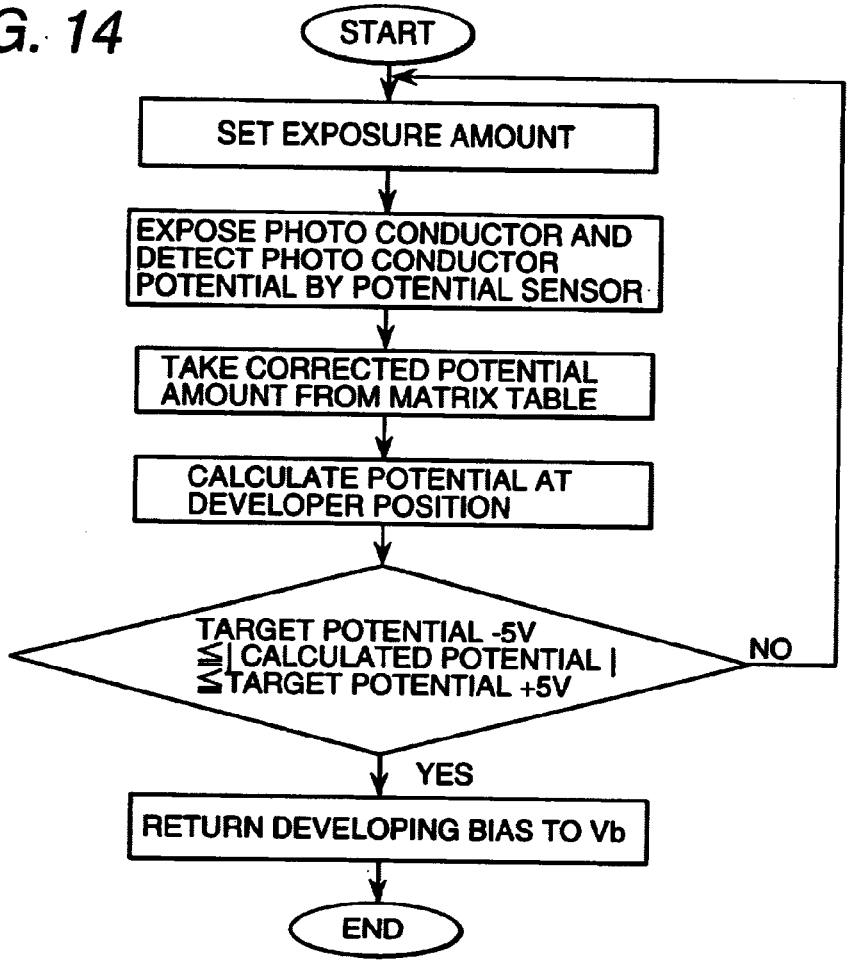
FIG. 14 is a flowchart showing a process of calculation of the potential at the developing position.

FIG. 15 shows a matrix table of the humidity and the is surface charge density various stored in the dark decay storage portion. Upon detection of a potential, the humidity is detected by a humidity sensor 13 arranged internally. Furthermore, the layer thickness of the photo conductor is detected by means of the charge density counter 11. FIG. 12 is a flowchart showing a process for detecting the internal humidity of the image forming apparatus. On the basis of the detection value, the dark decay potential amount of the photo conductor is extracted from the dark decay storage portion 14. Then, the potential on the surface of the photo conductor at the developing position is calculated by adding the detected potential and is reproduced. FIG. 14 is a flowchart showing a process for calculating the potential of the surface of the photo conductor at the developing position.

Figure 11:
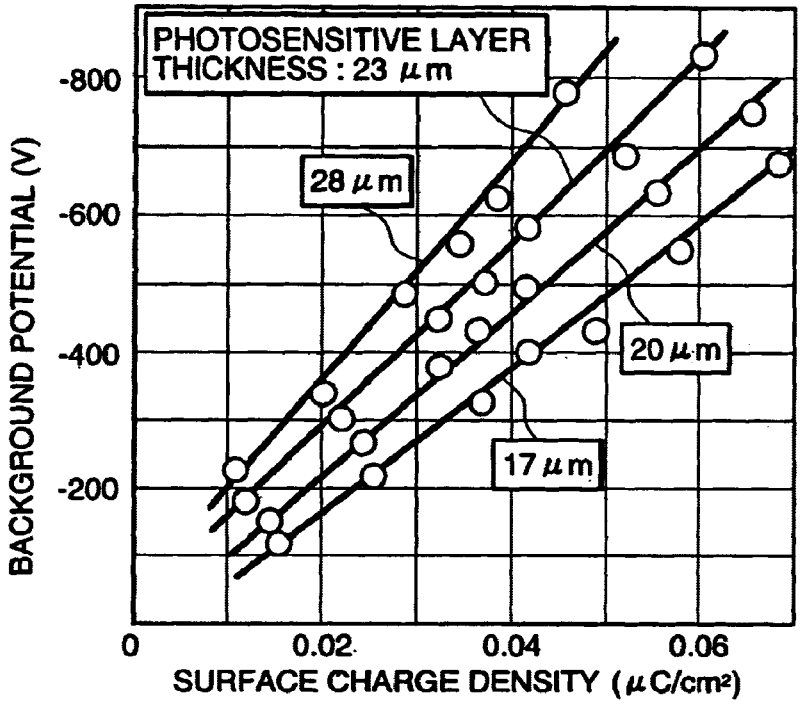
FIG. 11 is a graph showing a relationship between surface charge density depending upon the layer thickness of the photo conductor and the background potential.

It should be noted that, in the illustrated embodiment of the image forming apparatus, a method of detecting the layer thickness of the photo conductor is to predict the layer thickness by measuring an inflow current by means of the charge density counter 11. FIG. 11 is a graph showing a relationship between the surface charge density of the photo conductor drum 1 and the charge potential (background potential) 0V while taking the layer thickness of the photo conductor as a parameter. When the surface charge density and the background potential are known, the layer thickness of the photo conductor can be derived. In the illustrated embodiment of the image forming apparatus, a corotron type charger is employed as the charger. The difference between the current applied to a wire of the charger 2 and the current flowing through a shield is measured by the charge density counter 11. The counted value is the value of a current flowing through the photo conductor drum, which becomes a value proportional to the surface charge density. On the other hand, the background potential is detected by the potential sensor. From these two values, i.e., the current value flowing through the photo conductor drum and the background potential, the layer thickness of the photo conductor layer is derived.

FIG. 13 is a flowchart showing a process for deriving the surface charge density of the photo conductor. It should be noted that determination of the layer thickness of the photo conductor layer in a similar manner is possible even when the scorotron charger is employed in the illustrated embodiment of the image forming apparatus. However, at this time, since the charge density counter 11 counts the value of the current flowing through the photo conductor drum 1, counting is performed by subtracting the current flowing through the grid and shield from the current applied to the wire.

Figure 16:
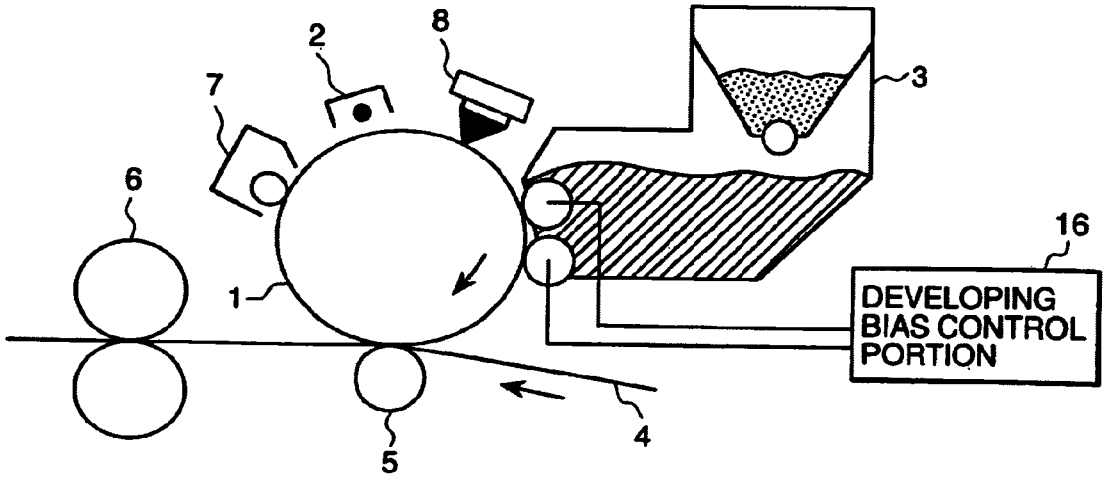
FIG. 16 is a diagrammatic illustration of the preferred embodiment of the image forming apparatus.

Next, as another embodiment, an application sequence of the developing bias upon initiation of printing will be discussed with reference to FIGS. 16 to 18. FIG. 16 is a diagrammatic illustration showing a section of this embodiment of the image forming apparatus. The image forming apparatus includes a photo conductor drum 1, a charger 2, a developing device 3, a sheet of printing paper 4, a transfer device 5, a fixing device 6, a cleaning device 7, an exposure device 8 and a developing bias control portion 16.

Figure 17:
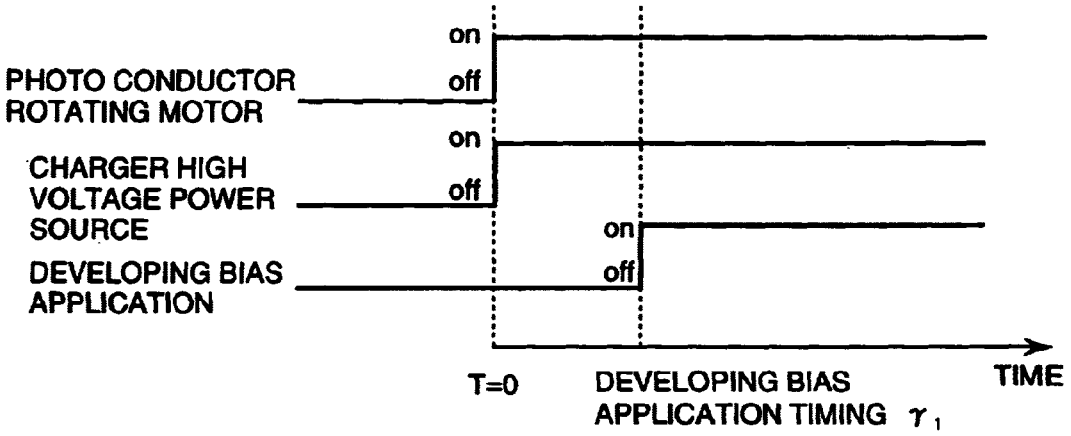
FIG. 17 is a timing chart of a developing bias application upon initiation of printing.

FIG. 17 shows a control sequence of a respective portion of the printing and transferring unit upon starting of printing. At first, a motor for rotatingly driving the photo conductor and a voltage supply device of the charger for charging the photo conductor are actuated. A period within which the surface potential of the photo conductor reaches the potential equal to the developing bias or higher is preliminarily measured. After the preliminary measurement period, the developing bias is applied. The period in which the potential of the photo conductor rises is variable depending upon the photo conductor to be used.

In case of a developing device having a plurality of developing rollers, the timing to apply a developing bias is sequentially controlled from the upstream side in the rotating direction of the photo conductor. After exposure, the timing of application of the developing bias to the first developing roller is assumed to be $\gamma_1$. Then, application timings for applying the developing bias for the (N)th developing roller is expressed by $\gamma_N=\gamma_{N-1}+(N-1)\times L/v$, wherein L is the distance between the developing nips of the (N)th developing roller and the (N−1)th developing roller, and v is the processing speed.

Figure 18:
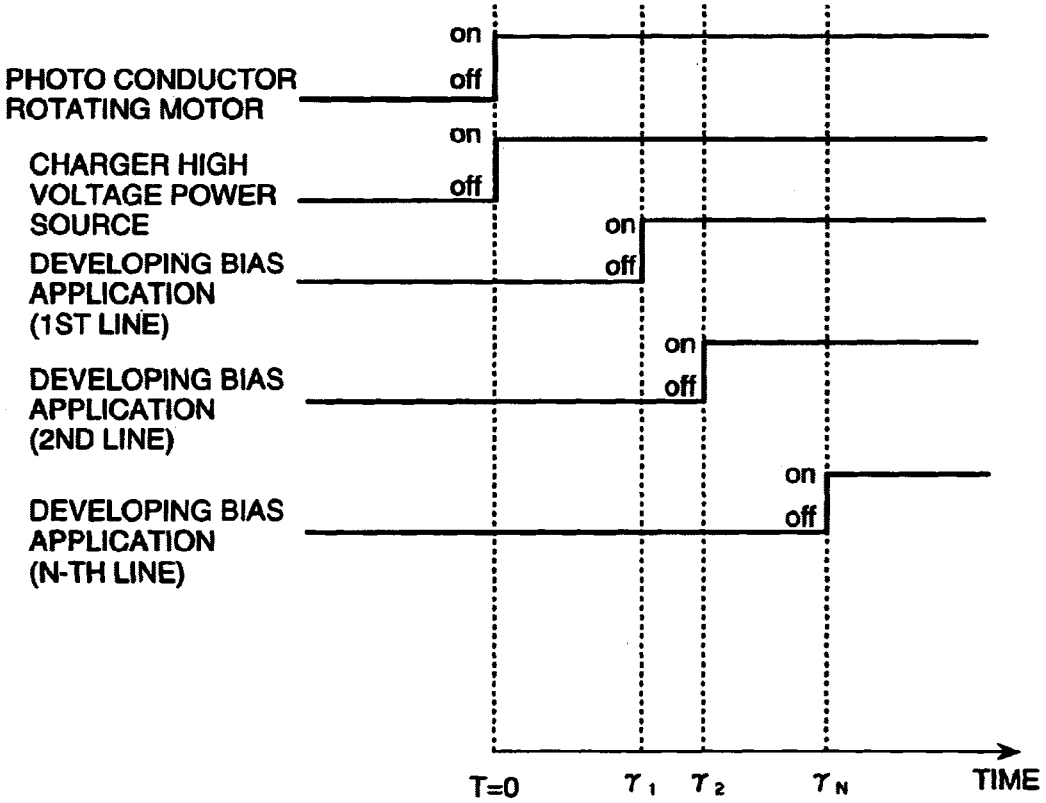
FIG. 18 is a timing chart of the developing bias application of a developing device having a plurality of developing rollers.

FIG. 18 is a timing chart of developing bias application of a development device having a plurality of developing rollers. By setting the application timing of the developing bias, extra toner will not deposit on the photo conductor. In this way, even with an image forming apparatus of the roller transfer system or belt transfer system, a staining of the transfer device by toner is prevented, thereby to lengthen the replacement cycle of the transfer parts. On the other hand, since it is possible to avoid transfer of an extra amount of toner to the cleaning device, it also becomes possible to lengthen the replacement cycle of the cleaning member (blade, brush or the like).

Next, variation of the layer thickness of the photo conductor on the photo conductor drum and control of the peripheral electric field will be discussed with reference to FIGS. 19 to 25.

In the illustrated embodiment, the potential of the surface of the photo conductor drum 1 is detected by the potential sensor 10. On the basis of the detection value, the amount of exposure produced by the exposure device 8 can be adjusted by the exposure control means 9. On the other hand, the charge density on the surface of the photo conductor drum 1 can be counted by the charge density counter 11, and the amount of exposure of the exposure device 8 can be adjusted on the basis of the counted value by the exposure control means 9.

Figure 19:
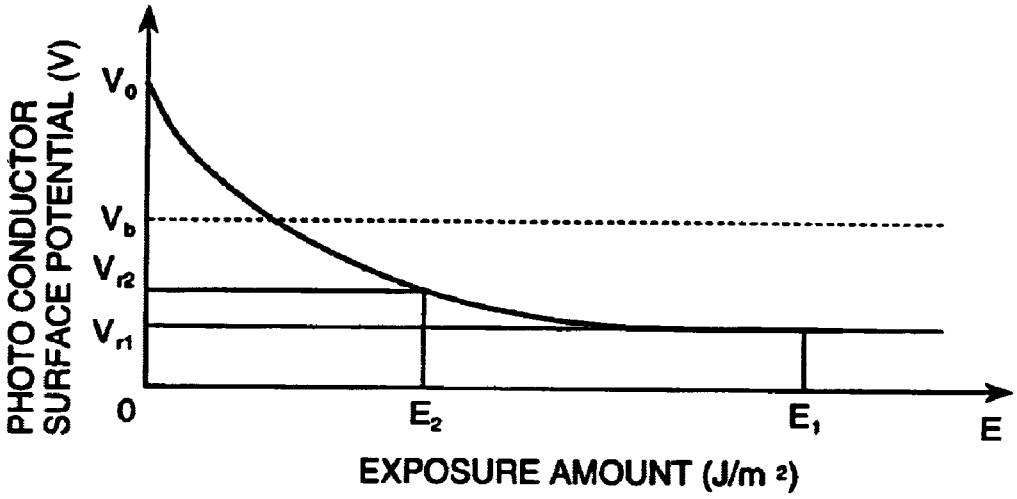
FIG. 19 is a graph showing optical response characteristics of a photo conductor drum.

FIG. 19 is a graph showing the optical response characteristics of the photo conductor drum 1. In FIG. 19, the horizontal axis represents the exposure amount and is illustrated as the optical energy applied to the photo conductor drum 1. The vertical axis represents the potential of the photo conductor drum 1 within a given period after exposure. The period after exposure is set to be equal to the period required from exposure to the development in the illustrated embodiment of the image forming apparatus. On the vertical axis, V0 represents the background potential (charge potential) in development. In the illustrated device, the amount of exposure produced by the exposure control means 9 is variable between two stages respectively represented by E1 and E2. Vr1 on the vertical axis represents the potential on the photo conductor 1 corresponding to the exposure amount E1, and Vr2 is the potential on the photo conductor 1 corresponding to the exposure amount E2. Vb represents the bias voltage of the developing device, and Vb−Vr1 and Vb−Vr2 are developing potential difference. The exposure control means 9 is controlled so that, for a wide solid region (solid image), Vb−Vr1 is used as the developing potential, and on the other hand, for a line drawing or halftone dot, to which the peripheral effect of the electric field acts strongly, Vb−Vr2 is used as the developing potential.

Here, a discussion will be given for variation in elapsed time of the electrostatic latent image on the photo conductor surface. When the degree of fatigue is increased according to an increase in the printing amount, the potential (charge potential) of the charge region is lowered to a level where charging becomes difficult. Accordingly, lowering of the background potential Vo is caused. However, since the illustrated embodiment employs a scotoron type charger, only slight lowering of the background potential V0 is caused. On the other hand, the potential (discharge potential) of the discharge region is elevated to make discharge difficult. Lowering of the discharge performance is significant when an intermediate potential region that is not completely radiated is produced by not providing a sufficient amount of exposure. In the illustrated embodiment, the intermediate potential is Vr2.

The foregoing variation of potential makes the development potential difference smaller, which serves to lower the developing electric field. On the other hand, in addition to these characteristics, in response to an increase in the printing amount, the thickness of the photo conductor layer of the photo conductor is reduced by wear. Reduction of the developing electric field due to reduction of the developing potential difference can be said to occur with respect to both the peripheral electric field and the internal parallel electric field portion.

However, an increase in the developing electric field due to reduction of the layer thickness of the photo conductor layer is caused only in the peripheral electric field. An image, for which two opposite tendencies are significant, are line drawings, dots or the edge portion of a solid region to be influenced by the developing electric field by the peripheral effect. Which of mutually opposite tendencies is dominant is variable depending upon the printing apparatus and the history of printing and so forth. Namely, a variation of the developing performance is caused according to the elapsed time to cause variation of the image quality. This means that the mode of variation is variable depending upon the printing apparatus, or even in an apparatus of the same construction, depending upon the history of printing.

Figure 20:
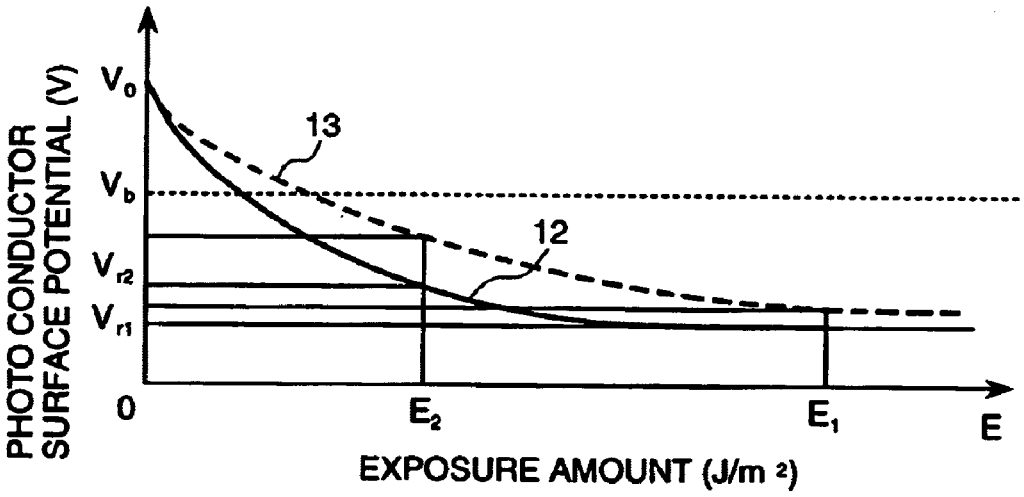
FIG. 20 is a graph showing the optical response characteristics of an initial condition and a fatigue condition of the photo conductor drum.

FIG. 20 is a graph showing optical response characteristics of a photoconductive drum 1 similar to FIG. 19. FIG. 20 illustrates two conditions, i.e. an initial condition and a condition of the end of life where fatigue has progressed. In FIG. 20, the solid line (12) represents the initial condition, and the broken line (13) represents the fatigued condition. Due to fatigue, V0 is lowered but falls within a range not significantly affecting for the image quality. It should be appreciated that the influence of fatigue is greater in case of the potential (Vr2) corresponding to E2 in comparison with the potential (Vr1) corresponding to E1.

Accordingly, in the illustrated embodiment of the image forming apparatus, the exposure amount E2 is variable so as to control the exposure amount E2 for maintaining the surface potential Vr2 of the photo conductor drum 1 constant.

Figure 21A:
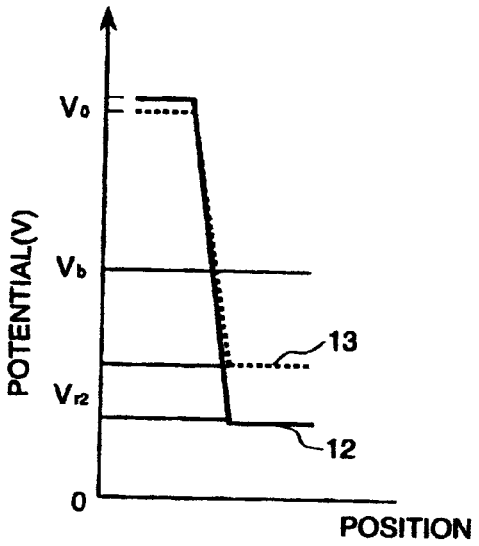
FIGS. 21(*a*) and 21(*b*) are diagrams showing one example of the potential of a latent image on the photo conductor drum and the electric field distribution, respectively.
Figure 21B:
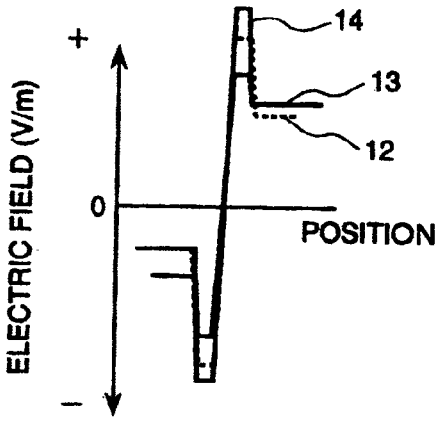

FIGS. 21(*a*) and 21(*b*) show examples of the potential and electric field distribution of the latent image on the photo conductor drum 1. FIG. 21(*a*) shows the potential distribution, and FIG. 21(*b*) shows the electric field distribution. Concerning the condition of the photo conductor drum 1, the solid line (12) represents the case where the photo conductor is in an initial condition, and thus the control is not applied for the exposure amount E2; and, the broken line (13) represents the case where the photo conductor is in a fatigue condition, and thus control is applied for the exposure amount E2. As discussed in connection with FIG. 20, the photo conductor drum 1 is subject to fatigue so that V0 lowers, Vr2 rises and the developing potential is lowered. Conversely, due to reduction of the layer thickness of the photo conductor 1 on the photo conductor drum 1, the developing electric field corresponding to the developing potential is increased. FIG. 21(*b*) shows the electric field distribution in the case where Vr2 is controlled to be constant. An increase in the developing electric field becomes significant.

ON the other hand, FIGS. 21(*a*) and 21(*b*) show the case where the developing electric field is increased when control for keeping Vr2 constant is not applied. In a different fatigue condition of the photo conductor drum 1, it is possible that the developing electric field will be lowered. In either case, when control is effected for making Vr2 constant, only the influence due to reduction of the layer thickness is produced, the development electric field is increased.

As set forth above, the electric field is increased by two independent factors, which consist of the potential difference and the layer thickness. Accordingly, it becomes necessary to effect control to maintain both the potential and the electric field constant for stably maintaining a constant image quality with elapsed time. The potential is controlled so as to be constant by deriving the potential in the developing device 3 from a detection value produced by the potential sensor 10 and adjusting the amount of exposure produced by the device 8 using the exposure control means 9 on the basis of the derived value. On the other hand, for controlling the electric field, it is, at first, required to know the strength of the electric field. The strength of the electric field is determined by the layer thickness of the photo conductor, as set forth above. Accordingly, when the layer thickness of the photo conductor can be detected with high precision, control of the electric field becomes possible.

Figure 22:
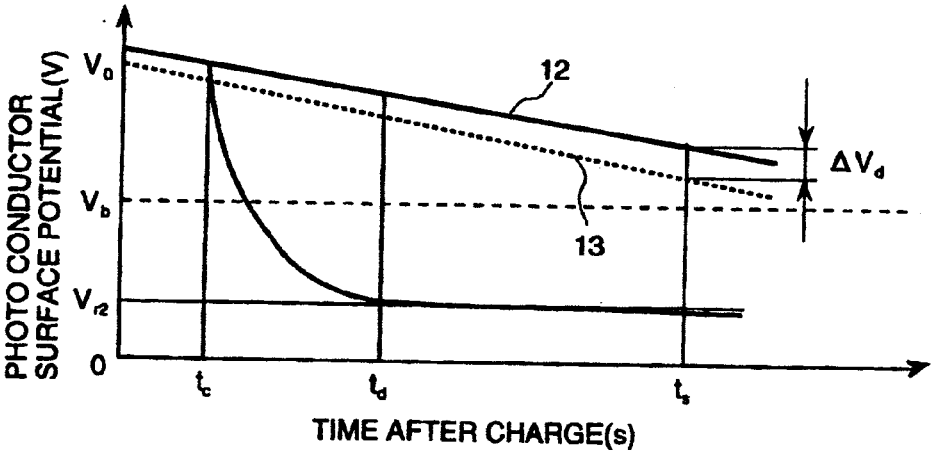
FIG. 22 is a graph showing variation after charging of the surface potential of the photo conductor drum.

FIG. 22 shows a variation of the surface potential of the photo conductor drum 1 after charging. In FIG. 22, the vertical axis represents the surface potential of the photo conductor and the horizontal axis represents the elapsed period after charging. In FIG. 22, tc represents the start of exposure by the exposing device 8, td represents the start of developing by the developing device 3, and ts denotes the start of potential detection timing by the potential sensor 10. Concerning the photo conductor drum 1, the solid line (12) represents the initial condition and the broken line (13) represents a fatigued condition. Abrupt lowering of the surface potential from the exposure timing tc shows the variation of the potential in the region of a thin line or a dot image region where the developing potential becomes Vr2 at the developing time td, among light irradiating portions of the surface of the photo conductor.

The constant lowering of the surface potential of the photo conductor before and after the exposure time tc represents the potential variation of the background where the light is not irradiated. Such constant lowering of potential is caused by dark decay. When using the scorotron charger 2, the surface potential of the photo conductor upon charging (time 0) becomes slightly higher in case of the initial condition of the photo conductor drum in comparison with that in the fatigued condition. However, the difference is quite small and can be ignored.

In the illustrated embodiment, in ignoring such a small difference, it is considered that the surface potential of the photo conductor upon charging (time 0) is substantially constant irrespective of the fatigue condition. On the other hand, on the basis of the detection value of the potential sensor 10, the exposure amount is adjusted so that Vr2 is constant. Therefore, variation of the potential in a thin line or dot image region is substantially constant irrespective of the fatigue condition of the photo conductor drum.

On the other hand, the dark decay speed is higher in the fatigued condition in comparison with the initial condition of the photo conductor drum. The attenuation speed difference is caused due to a difference in the layer thickness of the photo conductor, since the potential at the charging timing is substantially equal. The difference in the charge potential due to a difference of the fatigue condition of the photo conductor is shown as the dark decay potential difference ΔVd.

Figure 23:
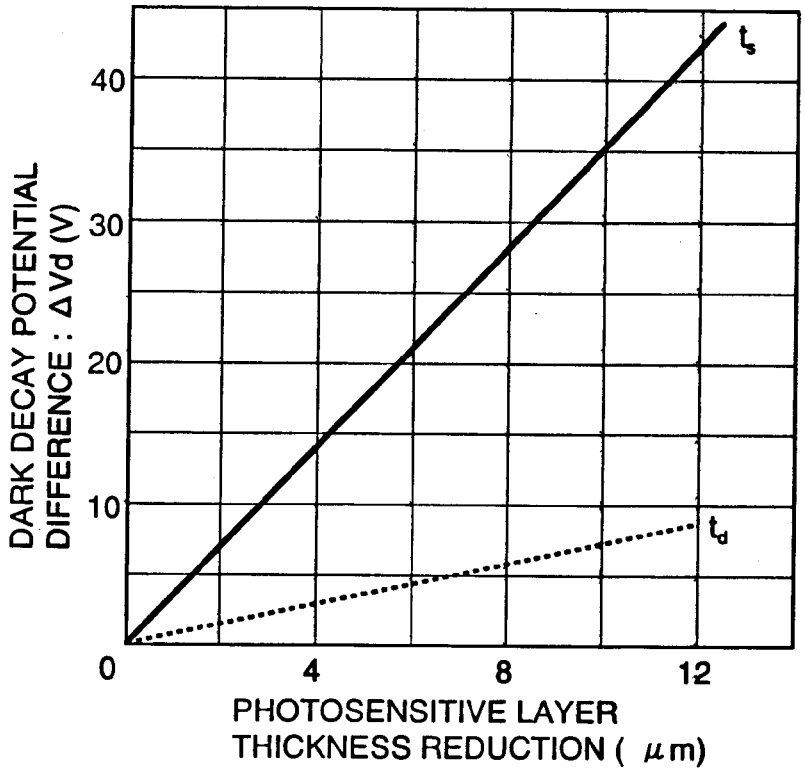
FIG. 23 is a graph showing the variation relative to a reduction amount of a photo conductor layer thickness of a dark decay potential difference $\Delta Vd$.

FIG. 23 is a graph showing variation of the dark decay potential difference ΔVd as measured at the potential detection timing ts by the potential sensor 10 and as measured at the developing timing td by the developing device 3. By detecting the dark decay potential difference ΔVd, reduction of the layer thickness of the photo conductor can be seen. However, at the developing timing td, the dark decay potential difference ΔVd is quite small to the extent that lowering of the background potential does not influence the image, and a sufficient resolution (precision) of the output of the potential sensor for detecting the difference cannot be obtained. Accordingly, in the illustrated embodiment, where the potential sensor 10 is provided downstream of the transfer device 5, a large dark decay potential difference ΔVd appears. Therefore, the dark decay potential difference ΔVd can be obtained with sufficiently high precision by measuring the background portion potential, to make reduction of the layer thickness of the photo conductor at that timing clear.

With the construction set forth above, by detecting the reduction of the layer thickness of the photo conductor by use of a method of measuring only the charge potential, high precision detection of the layer thickness of the photo conductor becomes possible.

Conversion of the output of the potential sensor 10 to the component of reduction of the layer thickness of the photo conductor can be calculated by the exposure control means 9, to which the initial background potential at the position of the potential sensor 10 is input. Also, the amount of reduction of the layer thickness and the increase in the peripheral current are preliminarily known and are stored in the exposure control means 9 in the form of a table. The value corresponding to expansion of the peripheral electric field is determined on the basis of the internal table. On the basis of this value, the control by exposure for reducing the peripheral electric field depending upon the amount of reduction of the layer thickness is provided from time to time.

Figure 24:
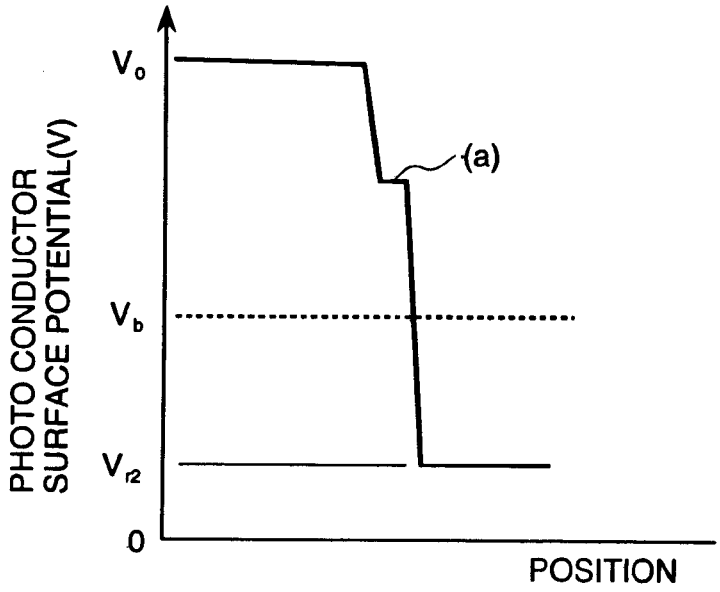
FIG. 24 is a graph showing a potential distribution of the photo conductor drum surface upon developing when a circumferential electric field control is performed.

FIG. 24 is a graph showing the potential distribution on the surface of the photo conductor drum 1 during development upon performing control to weaken the foregoing peripheral electric field (hereinafter referred to as electric field control). In FIG. 24, a slight step in the potential distribution, as shown at (a), is caused on the way of variation from the charge potential to the discharge potential. This position corresponds to the position around the image and is formed by lowering the exposure amount. It should be noted that the exposure for forming the stepwise distribution is referred to as auxiliary exposure. While a dedicated exposure device may be newly employed for producing the auxiliary exposure, it is also possible to control the exposure amount of the exposure device 8 to produce a multi-value output.

By such auxiliary exposure, an abrupt potential variation around the image is prevented. As a result, the peripheral electric field can be reduced. On the other hand, a step portion of the stepwise distribution is provided between the bias voltage Vb and the background potential V0. If the step portion is provided between the bias voltage Vb and the discharge potential Vr2, the step portion falls within the image region so as to cause variation of the density at the position corresponding to the step portion, thereby to form a low density region from the step portion to the outside of the image region.

Accordingly, by providing the step portion between the bias voltage Vb and the background potential Vo outside of the image region, the problem that the presence of the step portion appears on the image can be avoided. The dot density of the illustrated embodiment of the image forming apparatus is 600 dot/inch. The image signal is taken in the memory before exposure and the peripheries of all images are detected by a pattern matching method to apply auxiliary exposure for two dots along the periphery of the image. The foregoing internal table of the exposure control means is prepared in relation to the layer thickness of the photo conductor layer and the auxiliary exposure amount. Thus, the intensity of the auxiliary exposure is determined depending upon the layer thickness of the photo conductor.

Figure 25A:
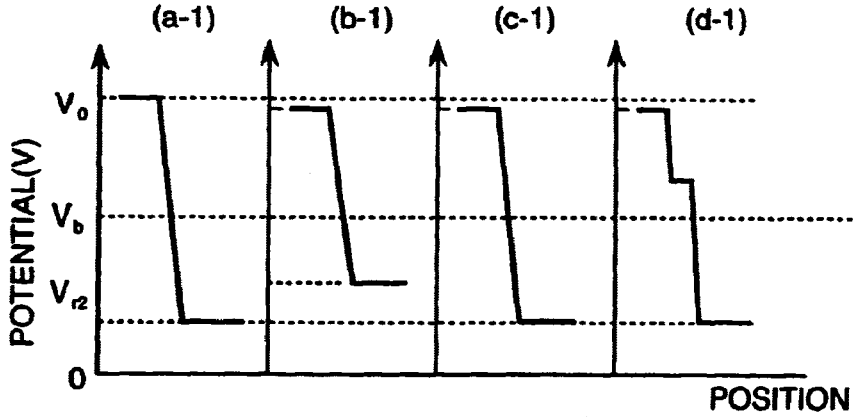
FIGS. 25(*a*) and 25(*b*) are diagrams showing the potential and electric field distribution, respectively, of a Vr2 image region depending upon presence and absence of control.
Figure 25B:
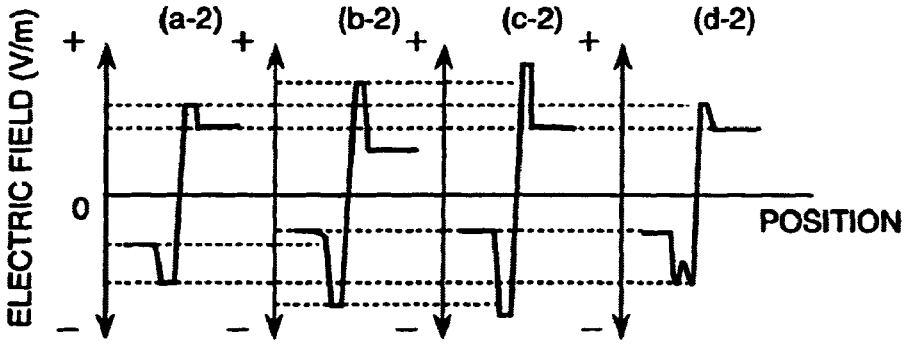

In FIGS. 25(*a*) and 25(*b*), the characteristic (a-1) shows the surface potential distribution including the Vr2 image region of the photo conductor in the initial condition, in the illustrated embodiment, and the characteristic (a-2) shows the electric field distribution corresponding to the characteristic (a-1) of the photo conductor in the initial condition. The characteristic (b-1) shows the surface potential distribution including the Vr2 image region, of the photo conductor in a fatigued condition, in the illustrated embodiment, and the characteristic (a-2) shows the electric field distribution corresponding to the characteristic (a-1) of the photo conductor in the fatigued condition. The characteristic (c-1) shows the surface potential distribution including the Vr2 image region, of the photo conductor in a fatigued condition, when only the potential is controlled so as to be constant, in the illustrated embodiment, and the characteristic (c-2) shows the electric field distribution corresponding to the characteristic (c-1). The characteristic (d-1) shows the surface potential distribution including the Vr2 image region of the photo conductor in a fatigued condition, when the potential and electric field are controlled according to the method used in the illustrated embodiment, and the characteristic (d-2) shows the electric field distribution corresponding to the characteristic (d-1).

Comparing characteristics (a-1) and (a-2) and characteristics (d-1) and (d-2) of FIGS. 25(*a*) and 25(*b*), by controlling the potential in the image portion to that it is constant and controlling the electric field by forming stepwise distribution by the auxiliary exposure on the way from the charge potential to the discharge potential (potential of the exposure portion), the potential and the electric field of the image portion can be maintained in the same condition as the initial condition even in a photo conductor in a fatigued condition.

In the illustrated embodiment, in the wide solid region (solid image) where a parallel electric field and a peripheral electric field are present in an admixing manner, the discharge potential of Vr1 is used. Since Vr1 is a relatively stable potential, control for maintaining the potential constant is not applied. However, even in this region, an increase of the electric field due to reduction of the layer thickness of the photo conductor makes it desirable to apply electric field control by auxiliary exposure similar to the discharge potential region of Vr2. In this way, even in the wide solid region (solid image) where the parallel electric field and peripheral electric field are present in an admixing manner, the image quality can be maintained stable even upon occurrence of fatigue in the photo conductor.

In the embodiment set forth above, since the reduction of the layer thickness of the photo conductor is detected by measuring only the charge potential at a position downstream of the developing position, it may not be influenced by the exposure, thereby to permit detection of the photo conductor with high precision. On the other hand, by forming the stepwise distribution by auxiliary exposure, the electric field can be controlled to maintain the potential and electric field in the image portion even in a photo conductor in a fatigued condition compared with those of a photo conductor in the initial condition. On the other hand, even for a wide solid region (solid image) where the parallel electric field and peripheral electric field are present in an admixing manner, by applying auxiliary exposure for the peripheral portion of the image, the image quality can be maintained stable even in the case of a fatigue condition of the photo conductor.

Furthermore, by providing the step portion formed by the auxiliary exposure between the bias voltage Vb and the background potential Vo outside of the image region, the presence of the step portion will not be perceptible on the image.

Next, another embodiment of the present invention will be discussed.

Figure 26:
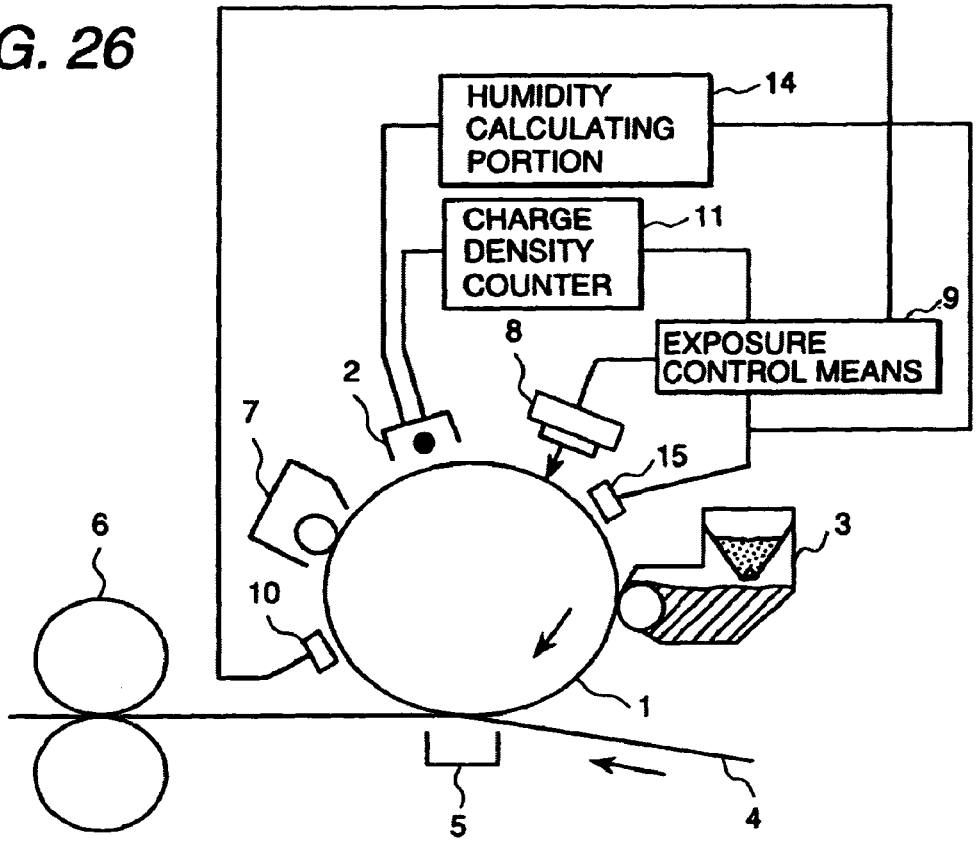
FIG. 26 is a diagrammatic illustration showing another embodiment of the image forming apparatus according to the present invention.

FIG. 26 is a diagrammatic illustration of the section of another embodiment of the image forming apparatus according to the present invention. In FIG. 26, the reference numeral 14 denotes a charge control device, and the reference numeral 15 denotes a second potential sensor. The illustrated embodiment of the image forming apparatus has the same construction and operation as the embodiment shown in FIG. 1, except for the fact that the charge control device 14 and the second potential sensor 15 are added, and the operation and effects associated with these additional components are added.

As set forth above, in the illustrated embodiment, associating with the fatigue of the photo conductor, the charge potential (V0) at the charge timing is lowered slightly. A cause of the lowering of the potential is not purely due to reduction of the layer thickness of the photo conductor, but is also due to the influence of fatigue of the other characteristics. The potential measurement value after dark decay by the potential sensor 10 becomes a value including a slight measurement error representing a potential lowering component. Therefore, a problem is encountered involving an increase of blooming in the background portion as time elapses. In the illustrated embodiment, the background potential (V0) is detected by the second potential sensor 15 so as to measure a lowering of the background potential (V0) in the charge control device 14. A grid voltage of the charger 2 is controlled depending on the measured value, so that the background potential (V0) becomes strictly constant. In this way, since the potential drop after dark decay can be measured accurately, the amount of reduction of the layer thickness of the photo conductor can be detected accurately.

Furthermore, in the illustrated embodiment, the discharge potential Vr2 is detected even by the second potential sensor 15 so as to derive the potential in the developing device 3 on the basis of the detection value from the potential sensor 10. Since the developing device 3 is located at a position between the two potential sensors 10 and 15, the discharge potential Vr2 at the position of the developing device 3 can be calculated accurately.

As set forth above, with the illustrated embodiment, since the second potential sensor 15 is located between the charger 2 and the developing device 3 to control the charge potential (background potential Vo) constant, reduction of the layer thickness of the photo conductor can be detected more accurately. On the other hand, since the discharge potential Vr2 at the position of the developing device 3 is calculated on the basis of the two detection values from the potential sensors 10 and 15 located at both sides of the developing device 3, the discharge potential Vr2 is accurately controlled.

Now, a further embodiment of the image forming apparatus according to the present invention will be discussed.

Figure 27:
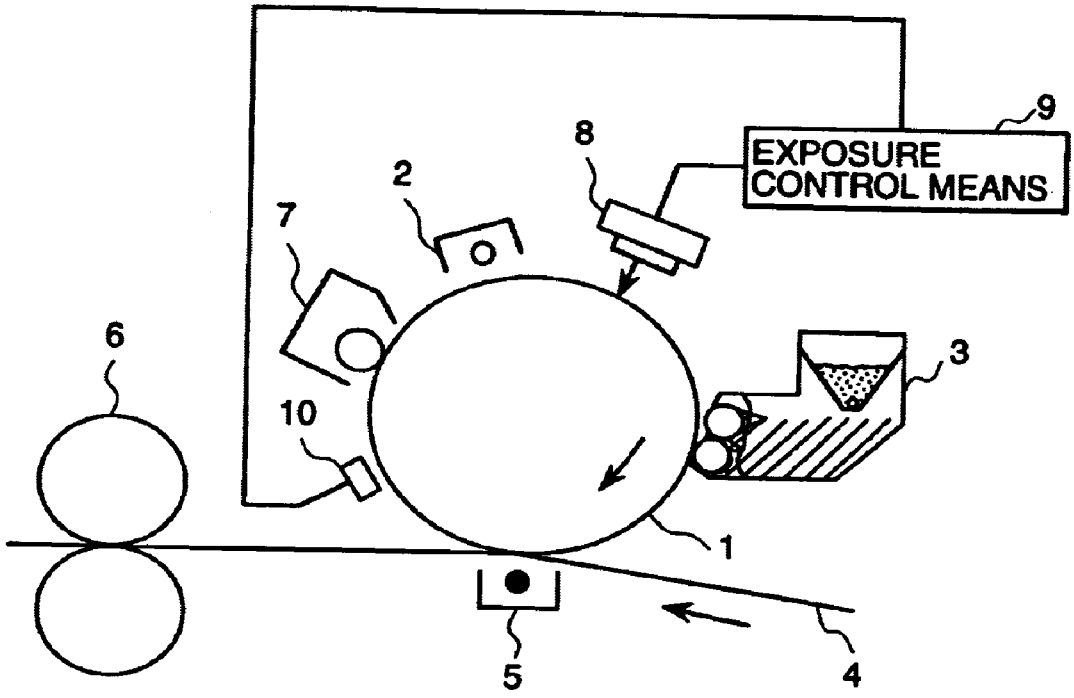
FIG. 27 is a diagrammatic illustration showing a further embodiment of the image forming apparatus according to the present invention.

FIG. 27 is a diagrammatic illustration of the section of a further embodiment of the image forming apparatus according to the invention. In the device shown in FIG. 1, a single developing roller is provided in the developing device 3, and the rotating direction the developing roller is the same as the rotating direction of the photo conductor drum 1 at the position mating with the photo conductor drum 1.

In the embodiment of the developing device illustrated in FIG. 27, the rotating directions of adjacent developing rollers are differentiated so that the respective developing rollers are rotated toward the photo conductor from a position where the two developing rollers are opposed with each other. From the position where the developing rollers are opposed with each other, the developer is separately carried toward the photo conductor. It should be noted that, in the illustrated embodiment, a two-component developer consisting of toner and a carrier is used in the developing device 3.

As can be appreciated from (d-2) of FIG. 25(*b*), in the illustrated embodiment of the image forming apparatus, the magnitude of the peripheral electric field developed in the background portion is suppressed so as to be equivalent to the photo conductor in its initial condition. However, since auxiliary exposure is added, the peripheral electric field has two small valleys, and there is a slight increase in the width of the auxiliary exposure. In this case, a problem of terminal deletion occurs, in which the rear end of the image relative to the rotating direction of the developing roller on the surface of the photo conductor drum 1 is difficult to be developed. The terminal deletion is caused by a mechanical factor in that, as the magnetic brush frictionally contacts the surface of the photo conductor, abrupt variation of the potential of the photo conductor from the background potential (V0) to the potentials (Vr1 and Vr2) of the image portion occur to the extent that the electric characteristics of the developer, as a mixture of the carrier beads and toner, cannot follow such an abrupt variation.

By employing a two developing roller type developing device, as in the illustrated embodiment, since the rotating directions of the two developing rollers are different, the rear end sides relative to the rotating direction of the developing rollers are different in the respective developing rollers. In this way, the developing rollers compensate each other so as to eliminate the problem of terminal deletion in which the end portion of the image is difficult to be developed.

As set forth above, in this embodiment, the problem of terminal deletion can be eliminated so as to stably maintain a high image quality as time elapses. It should be noted that detection of the layer thickness of the photo conductor can be performed simultaneously with printing. However, in order to further enhance the precision in detection, it is preferred to perform detection of the layer thickness of the photo conductor separately from printing. More particularly, by performing detection of the layer thickness of the photo conductor before initiation of printing, the potentials in the image region and the background region can be detected more accurately.

As set forth above, in accordance with the present invention, when the potential sensor for detecting a potential patch is provided downstream of the developing device formed of multiple stage developing rollers, a disturbance of the potential patch can be restricted so as to stably reproduce a high quality of image over a long period.

Also, even when a transfer roller or transfer belt is used in the transfer device, contamination of the transfer roller or transfer belt by toner can be successfully prevented.

Furthermore, since extra toner is not deposited on the photo conductor, the life of the cleaning device can be expanded.

Although the present invention has been illustrated and described with respect to exemplary embodiments thereof, it should be understood by those skilled in the art that the foregoing and various other changes, omissions and additions may be made therein and thereto, without departing from the spirit and scope of the present invention. Therefore, the present invention should not be understood as limited to the specific embodiments set out above, but to include all possible embodiments which can be embodied within a scope encompassed and equivalent thereto, with respect to the features set out in the appended claims.

What is claimed is:

1. An image forming apparatus comprising:

charging means for charging an image carrier;

exposure means for exposing image on the charged image carrier for forming a latent image;

at least one developing device, the at least one developing device including a plurality of developing rollers arranged in opposition with a surface of said image carrier and biasing applying means for applying a developing bias to the plurality of developing rollers, for supplying a developer on the image carrier and forming a developed image on the image carrier;

transfer means for transferring the developed image formed on the image carrier onto a printing medium;

a potential sensor provided downstream side of moving direction of the image carrier relative to the developing device for detecting a potential on the image carrier; and control means for setting the developing bias to a value restricting disturbance of a potential at a portion of the image carrier detected by the potential sensor when the portion of the image carrier passes across the developing device.

2. An image forming apparatus as set forth in claim 1, wherein setting of the developing bias for the plurality of developing rollers is performed in sequential order from the developing roller arranged on an upstream side in the moving direction of the image carrier.

3. An image forming apparatus as set forth in claim 1, which further comprises means for detecting by the potential sensor a potential of an image region where the latent image is formed, controlling the potential of the image region other than a solid image region among the image region on the basis of detection values thereof, detecting a layer thickness of a photo conductor and controlling a peripheral electric field of the image region including the solid image region.

4. An image forming apparatus comprising:

charging means for charging an image carrier;

exposure means for exposing image on the charged image carrier for forming a latent image;

developing means including a plurality of developing rollers arranged in opposition with a surface of said image carrier and biasing applying means for applying a developing bias to said plurality of developing roller, for supplying a developer on said image carrier and forming a developed image on said image carrier;

transfer means for transferring the developed image formed on said image carrier onto a printing medium;

a potential sensor provided downstream side of moving direction of said image carrier relative to said developing means for detecting a potential on said image carrier;

control means for setting said developing bias to a value restricting disturbance of a potential at a portion of said image carrier detected by said potential sensor by the developer when said potential portion passes across said developing means;

layer thickness detecting means for detecting a layer thickness of said image carrier;

a humidity sensor for detecting humidity around said image carrier; and dark decay storage means for storing a potential drop amount due to dark decay of said image carrier corresponding to detection values of said layer thickness detecting means and said humidity sensor; and at least one of a charge voltage of said charging means and a light amount of said exposure means is corrected on the basis of the potential drop derived from the detection values of said layer thickness detecting means and said humidity sensor.

5. An image forming apparatus comprising:

an image carrier;

charging means for charging an image carrier;

exposure means for exposing image on the charged image carrier for forming a exposure portion potential;

at least one developing device, the at least one developing device including a plurality of developing rollers arranged in opposition with a surface of the image carrier, biasing applying means for applying a developing bias to the plurality of developing rollers and a two component developer, for supplying a developer on the image carrier and forming a developed image on the image carrier;

transfer means for transferring the developed image formed on the image carrier onto a printing medium;

a potential sensor provided downstream side of moving direction of the image carrier relative to the developing device for detecting a potential on the image carrier; and control means for setting the developing bias to a value for restricting deposition of toner to the exposure portion potential when the exposure portion potential region passes across said developing device.

6. An image forming apparatus as set forth in claim 5 wherein the developing bias is set in sequential order from the developing roller arranged at an upstream side in the moving direction of the image carrier upon setting developing bias of the plurality of developing rollers.

7. An image forming apparatus as set forth in claim 5, wherein the developing bias is applied in sequential order from the developing roller arranged at an upstream side in the moving direction of the image carrier upon applying developing bias of the plurality of developing rollers.

8. An image forming apparatus as set forth in claim 5, which further comprises:

layer thickness detecting means for detecting a layer thickness of the image carrier;

a humidity sensor for detecting humidity around the image carrier; and dark decay storage means for storing a potential drop amount due to dark decay of the image carrier corresponding to detection values of the layer thickness detecting means and the humidity sensor; and at least one of a charge voltage of the charging means and a light amount of the exposure means is corrected on the basis of the potential drop derived from the detection values of the layer thickness detecting means and the humidity sensor.

9. An image forming apparatus comprising:

an image carrier;

charging means for charging an image carrier;

exposure means for exposing image on the charged image carrier for forming a exposure portion potential;

at least one developing device, the at least one developing device including a plurality of developing rollers arranged in opposition with a surface of the image carrier, biasing applying means for applying a developing bias to the plurality of developing rollers and a two component developer, for supplying a developer on the image carrier and forming a developed image on the image carrier;

transfer means for transferring the developed image formed on the image carrier onto a printing medium;

a potential sensor provided downstream side of moving direction of the image carrier relative to the developing device for detecting a charge potential and an exposure potential on the image carrier; and control means for applying said developing bias at a value restricting splashing of carrier to the surface of said image carrier when said charge potential region passes through said developing device, and setting the developing bias to a value for restricting deposition of toner to said exposure portion potential when the exposure portion potential region passes across the developing device.

10. An image forming apparatus as set forth in claim 9 wherein the developing bias is set in sequential order from the developing roller arranged at an upstream side in the moving direction of the image carrier upon setting developing bias of the plurality of developing rollers.

11. An image forming apparatus as set forth in claim 9 wherein the developing bias is applied in sequential order from the developing roller arranged at an upstream side in the moving direction of the image carrier upon applying developing bias of the plurality of developing rollers.

12. An image forming apparatus as set forth in claim 9 which further comprises:

layer thickness detecting means for detecting a layer thickness of the image carrier;

a humidity sensor for detecting humidity around the image carrier; and dark decay storage means for storing a potential drop amount due to dark decay of the image carrier corresponding to detection values of the layer thickness detecting means and the humidity sensors; and at least one of a charge voltage of the charging means and a light amount of the exposure means is corrected on the basis of the potential drop derived from the detection values of the layer thickness detecting means and the humidity sensor.

13. An image forming apparatus comprising:

an image carrier;

charging means for charging an image carrier;

exposure means for exposing image on the charged image carrier for forming an exposure portion potential;

at least one developing device, the at least one developing device including a plurality of developing rollers arranged in opposition with a surface of the image carrier, biasing applying means for applying a developing bias to the plurality of developing rollers and a two component developer, for supplying a developer on the image carrier and forming a developed image on the image carrier;

transfer means for forming a transfer nip portion by contacting with the surface of the image carrier and transferring the developed image formed on the image carrier onto a printing medium in the transfer nip portion;

a potential sensor provided downstream side of moving direction of the image carrier relative to the developing device for detecting a charge potential and an exposure potential on the image carrier; and control means for applying said developing bias at a value restricting splashing of carrier to the surface of the image carrier when the charge potential region passes through the developing device, and setting the developing bias to a value for restricting deposition of toner to the exposure portion potential when the exposure portion potential region passes across the developing device.

14. An image forming apparatus as set forth in claim 13, wherein the developing bias is set in sequential order from the developing roller at an arranged upstream side in the moving direction of the image carrier upon setting developing bias of the plurality of developing rollers.

15. An image forming apparatus as set forth in claim 13 wherein the developing bias is applied in sequential order from the developing roller arranged upstream side in moving direction of said image carrier upon applying developing bias of the plurality of developing rollers.

16. An image forming apparatus as set forth in claim 13 which further comprises:

layer thickness detecting means for detecting a layer thickness of the image carrier;

a humidity sensor for detecting humidity around the image carrier; and dark decay storage means for storing a potential drop amount due to dark decay of the image carrier corresponding to detection values of the layer thickness detecting means and the humidity sensor; and at least one of a charge voltage of the charging means and a light amount of the exposure means is corrected on the basis of the potential drop derived from the detection values of the layer thickness detecting means and the humidity sensor.

17. An image forming apparatus comprising:

an image carrier;

charging means for charging an image carrier;

exposure means for exposing image on the charged image carrier for forming a exposure portion potential;

at least one developing device, the at least one developing device including a plurality of developing rollers arranged in opposition with a surface of the image carrier, biasing applying means for applying a developing bias to the plurality of rollers and a two component developer, for contacting the developer held on the developing rollers to the surface of the image carrier to form a developing nip and supplying a developer on the image carrier and forming a toner image on the image carrier in the developing nip;

transfer means for transferring the toner image formed on the image carrier onto a printing medium in the developing nip;

a potential sensor provided at a downstream side of the moving direction of the image carrier relative to said developing device for detecting a charge potential and an exposure potential on the image carrier; and control means for setting the developing bias to a value for restricting deposition of toner to said exposure portion potential when a tip end of the exposure portion potential region reaches a rear end of the developing nip in moving direction of the image carrier.

18. An image forming apparatus as set forth in claim 17 which comprises means for controlling a potential of an image region on the basis of a detection value of the potential sensor being constant, detecting a layer thickness of a photo conductor layer forming the image carrier, and controlling peripheral electric field of the image region.

19. An image forming apparatus comprising:

an image carrier;

charging means for charging an image carrier;

exposure means for exposing image on the charged image carrier for forming a exposure portion potential;

developing means including a developing roller arranged in opposition with a surface of said image carrier, biasing applying means for applying a developing bias to said developing roller and a two component developer, for contacting the developer held on said developing roller to the surface of said image carrier to form a developing nip and supplying a developer on said image carrier and forming a toner image on said image carrier in said developer nip;

transfer means for transferring the toner image formed on said image carrier onto a printing medium in said transfer nip;

a potential sensor provided at a downstream side of moving direction of said image carrier relative to said developing means for detecting a charge potential and an exposure potential on said image carrier;

control means for setting said developing bias to a value for restricting deposition of toner to said exposure portion potential when a tip end of said exposure portion potential region reaches a rear end of said developing nip in moving direction of said image carrier;

means for controlling a potential of an image region on the basis of a detection value of said potential sensor being constant, detecting a layer thickness of a photo conductor layer forming said image carrier, and controlling peripheral electric field of said image region;

a first potential sensor arranged within a range from said developing means toward said charging means in said moving direction of said image carrier; and a second potential sensor arranged within a range from said charging means toward said developing means in said moving direction of said image carrier;

wherein a potential of said charge potential region is controlled to be constant on the basis of a detection value of said second potential sensor, and the layer thickness of said photo conductor is detected on the basis of a detection value of said first potential sensor.

20. An image forming apparatus as set forth in claim 18 which employs an auxiliary exposure for controlling the peripheral electric field, an auxiliary exposure light is irradiated at a position of transition from a potential of the charge potential region to the exposure potential region for forming stepwise potential distribution.

21. An image forming apparatus as set forth in claim 19 wherein at least one stepwise potential distribution is formed between the developing bias voltage and a potential of the charge potential region.

* * * * *